US012571172B2

(12) United States Patent
Wang et al.

(10) Patent No.: US 12,571,172 B2
(45) Date of Patent: Mar. 10, 2026

(54) LARGE-SPAN CORRIDOR STRUCTURE COMPOSED OF ARC-SHAPED CANTILEVER TRUSSES AND STAY CABLE SUPPORTING STRUCTURES AND CONSTITUTING METHOD THEREOF

(71) Applicants: SHAOXING UNIVERSITY, Shaoxing (CN); ZHEJIANG INST. OF ARTCHITECTURAL DESIGN & RESEARCH, Hangzhou (CN)

(72) Inventors: Zhen Wang, Shaoxing (CN); Yang Zhao, Shaoxing (CN); Youdi Yuan, Shaoxing (CN); Xuelin Yang, Hangzhou (CN); Haochuan Qu, Hangzhou (CN); Junting Cheng, Hangzhou (CN); Zhi Ding, Hangzhou (CN); Ruhao Wang, Hangzhou (CN)

(73) Assignees: SHAOXING UNIVERSITY, Shaoxing (CN); ZHEJIANG INST. OF ARTCHITECTURAL DESIGN & RESEARCH, Hangzhou (CN)

( * ) Notice: Subject to any disclaimer, the term of this patent is extended or adjusted under 35 U.S.C. 154(b) by 541 days.

(21) Appl. No.: 18/022,222

(22) PCT Filed: Sep. 26, 2022

(86) PCT No.: PCT/CN2022/121245
§ 371 (c)(1),
(2) Date: Feb. 20, 2023

(87) PCT Pub. No.: WO2023/046144
PCT Pub. Date: Mar. 30, 2023

(65) Prior Publication Data

US 2024/0263407 A1 Aug. 8, 2024

(30) Foreign Application Priority Data

Sep. 26, 2021 (CN) ..... 202111127456.0

(51) Int. Cl.
*E01D 6/00* (2006.01)
*E01D 11/04* (2006.01)
(Continued)

(52) U.S. Cl.
CPC ..... *E01D 6/00* (2013.01); *E01D 11/04* (2013.01); *E01D 12/00* (2013.01); *E01D 19/14* (2013.01); *E01D 21/00* (2013.01)

(58) Field of Classification Search
CPC ..... E01D 6/00; E01D 11/04; E01D 12/00; E01D 19/14; E01D 21/00; E01D 2101/30; E04B 1/342; E04B 1/0046; E04B 7/14
See application file for complete search history.

(56) References Cited

U.S. PATENT DOCUMENTS 1,568,631 A * 1/1926 Shoemaker ..... E01D 6/00 14/7

FOREIGN PATENT DOCUMENTS

CN 112323610 A * 2/2021 ..... E01B 25/10
CN 113430908 B * 2/2023 ..... E01D 19/00
NO 338758 B1 * 10/2016

OTHER PUBLICATIONS

NO-338758-B1 english machine translation (Year: 2025).*
CN-113430908-B english machine translation (Year: 2025).*
CN-112323610-A english machine translation (Year: 2025).*

* cited by examiner

*Primary Examiner* — Angelo Trivisonno
(74) *Attorney, Agent, or Firm* — Dickinson Wright PLLC

(57) ABSTRACT

A large-span corridor structure composed of arc-shaped cantilever trusses and stay cable supporting structures is provided, comprising cantilever trusses with arc-shaped facades, orthogonal connecting trusses at a corridor, connecting trusses at cantilever portions, corridor truss structures, and stay cable supporting structures; the cantilever
(Continued)

trusses with arc-shaped facades are composed of two sets of ultra-long cantilever trusses with arc-shaped facades and triquetrous planes which are supported by ground and symmetrical, and each are set of ultra-long cantilever trusses with arc-shaped facades and triquetrous planes are formed of several ultra-long cantilever trusses with arc-shaped facades and triquetrous planes arranged in parallel at a certain distance. The beneficial effects of the present disclosure are: the large-span corridor structure composed of arc-shaped cantilever trusses and stay cable supporting structures provided serves the combination of the cantilever trusses with arc-shaped facades and the orthogonal truss at the corridor as the supporting truss core system, and the performance of lateral force resistance and torsion resistant of the overall structure can be enhanced by the connecting trusses at cantilever portions.

9 Claims, 16 Drawing Sheets

(51) Int. Cl.

| | |
|---|---|
| ***E01D 12/00*** | (2006.01) |
| ***E01D 19/14*** | (2006.01) |
| ***E01D 21/00*** | (2006.01) |

LARGE-SPAN CORRIDOR STRUCTURE COMPOSED OF ARC-SHAPED CANTILEVER TRUSSES AND STAY CABLE SUPPORTING STRUCTURES AND CONSTITUTING METHOD THEREOF

CROSS-REFERENCE TO RELATED APPLICATIONS

This application is a § 371 national phase entry of International Application No. PCT/CN2022/121245, filed Sep. 26, 2022, which claims priority to Chinese Patent Application No. 202111127456.0 filed on Sep. 26, 2021.

TECHNICAL FIELD

The present disclosure relates to the technical field of structural engineering, and in particular, to a large-span corridor structure composed of arc-shaped cantilever trusses and stay cable supporting structures and constituting method thereof.

BACKGROUND

A large-span corridor truss structures is a large-span steel structural system composed of multiple single-layer or multilayer truss structures, and has advantages such as light weight, large span, and high load performance. Large span is an important factor for evaluating the mechanical performance of such a system. The structural system is widely applied to the function of building space for air communication of public buildings, such as corridors, channels, sightseeing corridors and overpasses.

The supporting system of the corridor truss structures includes various forms such as a lower steel column support, a lower truss support, an upper truss suspending and a cable suspending, and the supporting position of the corridor truss structures comprise various forms such as two-end support, multipoint support and single-point support. When the landing support can only be provided in the middle of two sides as restrictions of the field conditions, and the corridor truss structures is needed to span large range, such as double cantilever corridor channel buildings when it is difficult to reinforce two sides of a building and there are buildings in the underground, and double cantilever corridor sightseeing channel buildings here are cases such as double the special support is needed to be provided in the middle of two sides, for example, river banks, containers, the corridor truss structures can only be effectively realized by means of a reasonable special support structural system construction.

The double-set landing cantilever truss support with arc-shaped facades is an effective lower truss support system. Because of the form of a cantilever structure with arc-shaped facades symmetrical on both sides, the supporting structure of the landing end is particularly important, and needs to be a fixed end that can bear a partial bending moment; The composite landing support composed of two sets of trusses is a reasonable and effective treatment way to strengthen; depending on the magnitude of the force, the cantilever truss can be considered to be in the form of a triangle with large lower and small upper. Thus, a reasonable and effective arrangement and a structural form of the arc-shaped landing cantilever trusses with arc-shaped facades is important factors in the overall load carrying performance of the main body supporting structure.

In order to improve the overall rigidity of the double-set cantilever trusses with arc-shaped facades with arc-shaped facades, forming an overall stress-bearing system by means of an orthogonal truss connecting arrangement is a relatively reasonable and effective solution, the orthogonal truss connecting arrangement includes orthogonal connecting trusses at a corridor and connecting trusses at cantilever portions. In order to adapt to an arc-shaped convex appearance of the cantilever trusses with arc-shaped facades, the orthogonal connecting trusses corresponding to the cantilever trusses with arc-shaped facades are arranged at intervals, and have a planar truss structure with different widths. Accordingly, a reasonable and effective orthogonal connecting trusses arrangement is an important factor for ensuring reliable carrying, overall bearing and implementation feasibility of a core system of an arc-shaped supporting truss with arc-shaped facades.

The corridor structure supported by the cantilever trusses with arc-shaped facades symmetrical on both sides cannot achieve the function of a super-large span and a super-large cantilever channel space. By means of the stay cable suspending of the double-set cantilever trusses with arc-shaped facades on the upper part of the corridor structure, a reasonable and feasible two-side support composite cantilever form supported on both sides can be formed. In order to disperse the effect of relatively small tension of the stay cable while stay cable achieving the aesthetic effect of the building, the suspending position of the stay cable can correspond to multiple sets of stay cable supporting structures, such as large-span portions, cantilever portions and cantilever ends of the connecting truss at cantilever portions along the upper portions of the corridor trusses. Due to the composite support of the cantilever truss and the stay cable, the overall structure is relatively inadequate in rigidity, has a vertical seismic effect, and is not negligible in design and analysis of comfort and vibration frequency. Thus, a reasonable and effective suspending arrangement and structural of the corridor structure and stay cable supporting structures is an important factor for achieving a reasonable force bearing, carrying and effective conversion of vertical loads of the overall structural system.

In addition, the large-span corridor structure system composed of stay cable supporting structures has the problems of complex connecting structure of joints, complex constitution of members, bearing performance and rigidity, etc., and a reasonable and effective design and construction scheme of the large-span corridor structure composed of stay cable supporting structures supported by double-set long cantilever trusses with arc-shaped facades is also an important factor for ensuring the bearing performance and normal use thereof.

In conclusion, it is necessary to research a form and a design method for a large-span corridor structure composed of arc-shaped cantilever trusses and stay cable supporting structures to adapted to design and bearing of a complexity large-span steel cantilever truss structural system of the bottom large-span space long cantilever on both sides and the building model composed of the top stay cable supporting structures.

SUMMARY

The purpose of the present disclosure is to overcome the shortcomings in the prior art. A large-span corridor structure composed of arc-shaped cantilever trusses and stay cable supporting structures provided by the present disclosure can achieve the carrying and system design of a complexity large-span steel corridor truss structure of the composite building model with bottom large-span space long cantilever support on both sides and top stay cable supporting.

The large-span corridor structure composed of arc-shaped cantilever trusses and stay cable supporting structures includes cantilever trusses with arc-shaped facades, orthogonal connecting trusses at a corridor, connecting trusses at cantilever portions, corridor truss structures, and stay cable supporting structures; the cantilever trusses with arc-shaped facades are located at both sides and composed of two sets of ultra-long cantilever trusses with arc-shaped facades and triquetrous planes which are supported by ground and symmetrical, and which each are formed of several ultra-long cantilever trusses with arc-shaped facades and triquetrous planes arranged in parallel at a certain distance, the orthogonal connecting trusses at the corridor are located between the several ultra-long cantilever trusses with arc-shaped facades and triquetrous planes of each cantilever truss with arc-shaped facades at a height of the corridor of each set of ultra-long cantilever trusses with arc-shaped facades, and is in the form of a planar truss and is orthogonally arranged with and rigidly connected to the cantilever trusses with arc-shaped facades; and forms a core supporting structure together with them, the connecting trusses at cantilever portions are located between the several ultra-long cantilever trusses with arc-shaped facades and triquetrous planes and are in the form of a planar truss, and are arranged at a certain distance and orthogonally rigidly connected to the ultra-long cantilever trusses with arc-shaped facades and triquetrous planes and serves as a lateral support and forms an overall lateral force resistance rigidity, the corridor truss structures are composed of a middle large-span corridor truss area and cantilever corridor truss areas on both sides, and are in the form of a double-layer-union jack-shaped diagonal bracing truss structure, whose cantilever ends are rigidly supported on the cantilever trusses with arc-shaped facades, and form a horizontal integral continuity truss structure, the stay cable supporting structures are located between the cantilever portions of the cantilever trusses with arc-shaped facades and the corridor truss structures; and includes stay cable supporting structures in the cantilever corridor truss areas and stay cable supporting structures in the large-span corridor truss area, top ends of stay cables of the stay cable supporting structures are suspended at a connection of the connecting trusses at cantilever portions and the cantilever trusses with arc-shaped facades or at top cantilever ends of the cantilever trusses with arc-shaped facades, bottom ends of the stay cables of the stay cable supporting structures are obliquely pulled and suspended at cantilever portions and large-span portion of the corridor truss structures.

A constituting method of the large-span corridor structure composed of arc-shaped cantilever trusses and stay cable supporting structures includes following steps:

S1. constituting a set of cantilever trusses with arc-shaped facades using outer chords of the cantilever trusses with arc-shaped facades, inner chords of the cantilever trusses with arc-shaped facades, vertical webs of the cantilever trusses with arc-shaped facades, and diagonal webs of the cantilever trusses with arc-shaped facades the two sets of the cantilever trusses with arc-shaped facades are symmetrically arranged at both sides based on a central positioning point, and bottoms of the cantilever trusses with arc-shaped facades are landing supported at bottom landing ends of the cantilever trusses with arc-shaped facades, the tops of the cantilever trusses with arc-shaped facades are cantilevered to top cantilever ends of cantilever trusses with arc-shaped facades to form a main body structure of the two sets of the cantilever trusses with arc-shaped facades landing fixedly supported;

S2. constituting orthogonal connecting trusses at the corridor in a form of planar truss using outer chords of the orthogonal connecting trusses at the corridor, inner chords of the orthogonal connecting trusses at the corridor, vertical webs of the orthogonal connecting trusses at the corridor and diagonal webs of the orthogonal connecting trusses at the corridor;

S3. arranging orthogonally the main body structure of the cantilever trusses with arc-shaped facades generated in S1 and the orthogonal connecting trusses at the corridor generated in S2, and connecting rigidly outer chord rigid connecting ends of the orthogonal connecting trusses at the corridor to inner chord rigid connecting ends of the orthogonal connecting trusses at the corridor, so as to form a core support framework together;

S4. constituting connecting trusses at cantilever portions using outer chords of the connecting trusses at cantilever portions, inner chords of the connecting trusses at cantilever portions, vertical webs of the connecting trusses at cantilever portions and diagonal webs of the connecting trusses at cantilever portions;

S5. connecting rigidly the connecting trusses at cantilever portions generated in S4 through cantilever portions of each set of the cantilever trusses with arc-shaped facades to outer chord rigid connecting ends of the connecting trusses at cantilever portions and inner chord rigid connecting ends of the connecting trusses at cantilever portions, so as to form an integral structure of high lateral force resistance rigidity and torsional rigidity;

S6. constituting each corridor truss structure using upper chords of the corridor truss structures, middle chords of the corridor truss structures, lower chords of the corridor truss structures, vertical webs of the corridor truss structures and diagonal webs of the corridor truss structures;

S7. connecting every corridor truss structure generated in S6 by roof connecting steel beams of the corridor truss structures and floor connecting steel beams of the corridor truss structures, so as to form the corridor truss structures, and enhancing corridor truss structures by stiffeners of steel truss joints at intersections of the diagonal webs of the corridor truss structures;

S8. improving in-plane torsional rigidity of the corridor truss structures generated in S7 by roof horizontal stay cables of the corridor truss structures and floor horizontal stay cables of the corridor truss structures;

S9. large-span supporting ends of the corridor truss structures is the outer chord rigid connecting ends of the orthogonal connecting trusses at the corridor, and cantilever supporting ends of the corridor truss structures is the inner chord rigid connecting ends of the orthogonal connecting trusses at the corridor;

S10. connecting bottom ends of stay cables of the stay cable supporting structures to bottom suspending ends of the stay cable supporting structures at joints of the upper chords of the corridor truss structures; connecting top ends of the stay cables of the stay cable supporting structures to the top cantilever ends of the cantilever trusses with arc-shaped facades, the inner chords of the connecting trusses at cantilever portions, or top suspending ends of the stay cable supporting structures, enhancing the upper chords of the corridor truss structures at joints of connecting ends of the stay cables by the stiffeners of the stay cable end joints.

An application of the large-span corridor structure composed of arc-shaped cantilever trusses and stay cable supporting structures in carrying and system design of a complexity large-span steel corridor truss structure of the composite building model with bottom large-span space long cantilever on both sides and top stay cable supporting, the long cantilever means that the maximum cantilever length of the structure is not less than 50 m, and the large-span means that the maximum space span of the structure is not less than 100 m.

Such a system is mainly used in a situation that the landing support can only be provided in the middle of two sides as restrictions of the field conditions, and the corridor truss structures is needed to span and suspend large range, typical applications are for example double cantilever corridor channel buildings when it could not reinforce two sides of a building and there are buildings in the underground, and double cantilever corridor sightseeing channel buildings here are cases such as double the special support is needed to be provided in the middle of two sides, for example, river banks, containers, the corridor truss structures.

The beneficial effects of the present disclosure are:

1. The large-span corridor structure composed of arc-shaped cantilever trusses and stay cable supporting structures provided by the present disclosure has a reasonable structural system and can achieve the carrying and system design of a complexity large-span steel corridor truss structure of the composite building model with bottom large-span space long cantilever support on both sides and top stay cable supporting and fully utilizes the advantages of the functions and composite building model with bottom large-span space long cantilever support on both sides, large-span and large cantilever, high carrying, high lateral force resistance and stay cable supporting and top stay cable supporting.
2. The large-span corridor structure composed of arc-shaped cantilever trusses and stay cable supporting structures provided by the present disclosure can achieve the functions and composite building model with bottom large-span space long cantilever support on both sides and stay cable supporting and top stay cable supporting based on the supporting truss core system composed of the cantilever trusses with arc-shaped facades and the orthogonal truss at the corridor, the performance of lateral force resistance and torsion resistant of the overall structure can be enhanced by the connecting trusses at cantilever portions, and the bottom large-span space long cantilever corridor truss structures on both sides and cantilever portions thereof can be stayed and suspended by the corridor truss structures and the stay cable supporting structure that form integral force model. It can achieve the building shape and function with bottom large-span space long cantilever support on both sides, high load-bearing and high lateral resistance and stay cable supporting structure while reducing the self-weight and ensuring the load-bearing performance.
3. Based on carrying performance analysis, and by controlling indexes such as carrying force (stress control), overall anti-side rigidity (lateral deformation control), anti-torsion performance (cycle ratio) and self-oscillation frequency (comfort degree), the present disclosure can further ensure the reasonable and effective overall structural system.
4. The large-span corridor structure composed of arc-shaped cantilever trusses and stay cable supporting structures provided by the present disclosure has specific member modules, clear force transmission. The overall system has large-span space at the bottom, long cantilever on both sides, high carrying performance and high anti-side rigidity. The composite building model with stay cable supporting structures is elegant. There is a wide application prospect in the large-span steel corridor truss structure of the composite building model with bottom large-span space long cantilever support on both sides and top stay cable supporting.

Figure 1A:
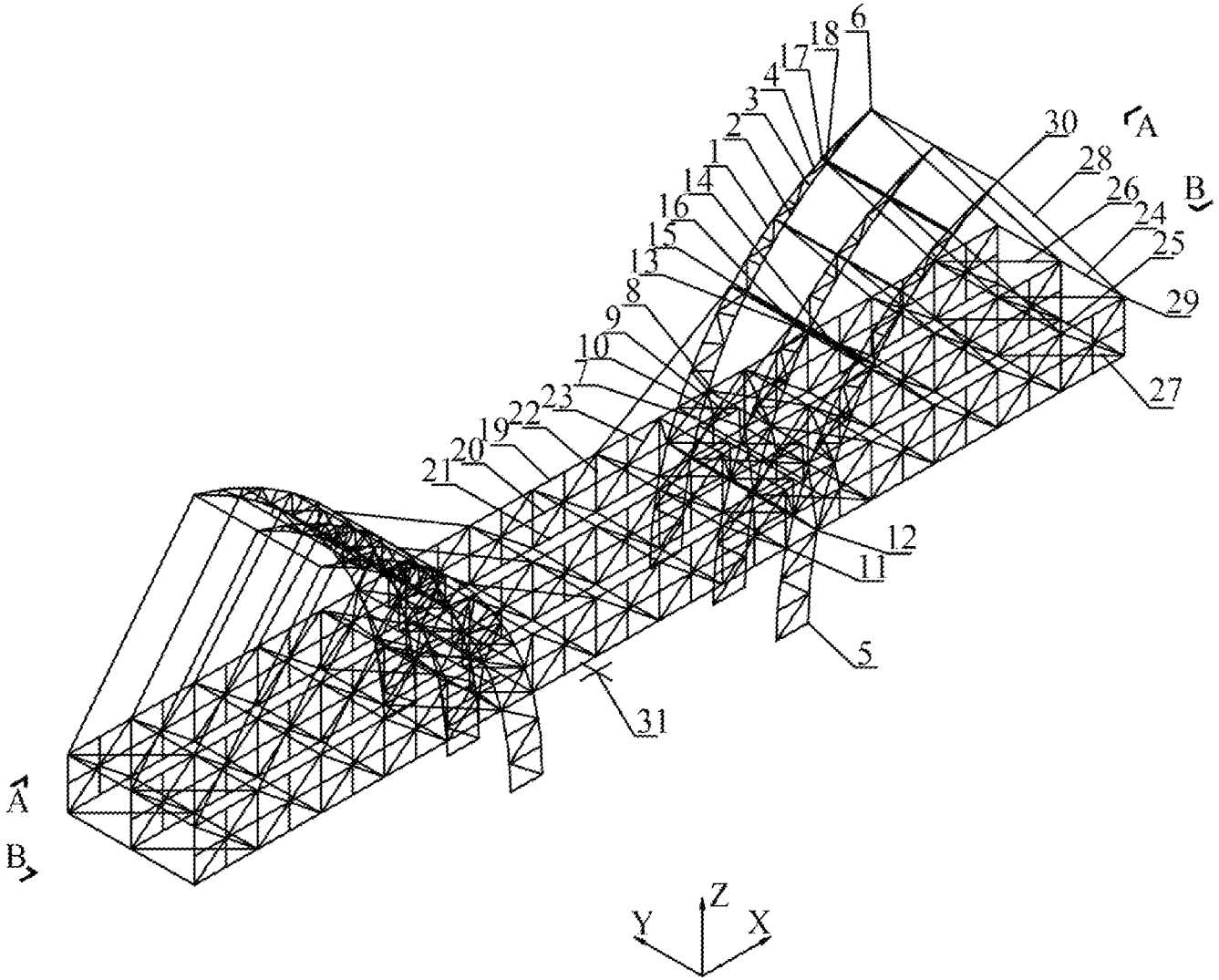
FIG. 1*a* is a schematic diagram of the overall structure of an embodiment of a large-span corridor structure composed of arc-shaped cantilever trusses and stay cable supporting structures according to the present disclosure.

Description of reference numbers: 1—outer chord of cantilever truss with arc-shaped facades; 2—inner chord of cantilever truss with arc-shaped facades; 3—vertical web of cantilever truss with arc-shaped facades; 4—diagonal web of cantilever truss with arc-shaped facades; 5—bottom landing end of cantilever truss with arc-shaped facades; 6—top cantilever end of cantilever truss with arc-shaped facades; 7—outer chord of orthogonal connecting truss at corridor; 8—inner chord of orthogonal connecting truss at corridor; 9—vertical web of orthogonal connecting truss at corridor; 10—diagonal web of orthogonal connecting truss at corridor; 11—outer chord rigid connecting end of orthogonal connecting truss at corridor (large-span supporting end of corridor truss structure); 12—innerchord rigid connecting end of orthogonal connecting truss at corridor (cantilever supporting end of corridor truss structure); 13—outer chord of connecting truss at cantilever part; 14—inner chord of connecting truss at cantilever part; 15—vertical web of connecting truss at cantilever part; 16—diagonal web of connecting truss at cantilever part; 17—outer chord rigid connecting end of connecting truss at cantilever part; 18—innerchord rigid connecting end of connecting truss at cantilever part; 19—upper chord of corridor truss structure; 20—middle chord of corridor truss structure; 21—lower chord of corridor truss structure; 22—vertical web of corridor truss structure; 23—diagonal web of corridor truss structure; 24—roof connecting steel beam of corridor truss structure; 25—floor connecting steel beam of corridor truss structure; 26—roof horizontal stay cable of corridor truss structure; 27—floor horizontal stay cable of corridor truss structure; 28—stay cable of stay cable supporting structure; 29—bottom suspending end of stay cable supporting structure; 30—top suspending end of stay cable supporting structure; 31—central positioning point; 32—stiffener of steel truss joint; 33—stiffener of stay cable end joint.

DETAILED DESCRIPTION OF THE EMBODIMENTS

The present disclosure will be further described below in conjunction with the embodiments, and the descriptions of the embodiments below are only used to help understand the present disclosure. It should be noted that, a person skilled in the art may further make improvements and modifications to the present disclosure without departing from the principle of the present disclosure, and these improvements and modifications also belong to the scope of protection of the present disclosure.

The large-span corridor structure composed of arc-shaped cantilever trusses and stay cable supporting structures has specific member modules, clear force transmission and complies with the design principles of the overall bearing and carrying mode, and fully utilizes the large space at the bottom, large span, large cantilever and high carrying performance of the overall structural system. Based on the supporting truss core system composed of the cantilever trusses with arc-shaped facades and the orthogonal truss at the corridor, the performance of lateral force resistance and torsion resistant of the overall structure can be enhanced by the connecting trusses at cantilever portions, and the bottom large-span space long cantilever corridor truss structures on both sides and cantilever portions thereof can be stayed and suspended by the corridor truss structures and the stay cable supporting structures, the functions and composite building model with bottom large-span space long cantilever support on both sides, high carrying, high lateral force resistance and stay cable supporting and top stay cable supporting can be achieved.

The design concept of the present disclosure is based on the supporting truss core structure composed of the cantilever trusses with arc-shaped facades and the orthogonal truss at the corridor, and the overall stress mode of the large-span corridor that the bottom large-span space long cantilever corridor truss structures on both sides and cantilever portions thereof can be stayed and suspended by the corridor truss structure- and the stay cable supporting structures is that: first, a vertical anti-side force member is taken as the cantilever trusses with arc-shaped facades, and is composite with the orthogonal connecting trusses at the corridor to form the supporting truss core system; second, the performance of lateral force resistance and torsion resistant of the overall structure can be enhanced by the connecting trusses at cantilever portions; then the bottom large-span space long cantilever corridor truss structures on both sides and cantilever portions thereof can be stayed and suspended and the functions of the bottom large-span space long cantilever support on both sides, and stay cable supported the composite building model composed of the top stay cable supporting structures can be achieved by the corridor truss structure and the stay cable supporting structures; finally, the overall stress-bearing performance of the structural system is ensured by the bearing performance analysis and control of the member stress, the overall rigidity, the torsion resistant performance and the self-oscillation frequency.

Embodiment 1

The embodiment of the present disclosure provides a large-span corridor structure composed of arc-shaped cantilever trusses and stay cable supporting structures according to the present disclosure. As shown in FIGS. 1*a*-1*f* and 2-4, the structure includes cantilever trusses with arc-shaped facades, orthogonal connecting trusses at a corridor, connecting trusses at cantilever portions, corridor truss structures, and stay cable supporting structures; the cantilever trusses with arc-shaped facades (FIG. 1*b*) are located at both sides and composed of two sets of ultra-long cantilever trusses with arc-shaped facades and triquetrous planes with fixed support on the ground and are symmetrical, and which each are formed of several ultra-long cantilever trusses with arc-shaped facades and triquetrous planes arranged in parallel at a certain distance; the orthogonal connecting trusses at the corridor (FIG. 1*c*) are located between the several ultra-long cantilever trusses with arc-shaped facades and triquetrous planes of each cantilever truss with arc-shaped facades at the height of the corridor, and is in the form of a planar truss and is orthogonally arranged with and rigidly connected to the cantilever trusses with arc-shaped facades, and forms a core supporting structure together with them; the connecting trusses at cantilever portions (FIG. 1*d*) are located between the several ultra-long cantilever trusses with arc-shaped facades and triquetrous planes and are in the form of a planar truss, and are arranged at a certain distance and orthogonally rigidly connected to the ultra-long cantilever trusses with arc-shaped facades and triquetrous planes and serves as a lateral support and forms an overall lateral force resistance rigidity; the corridor truss structures (FIG. 1*e*) are composed of a middle large-span corridor truss area and cantilever corridor truss areas on both sides, and are in the form of a double-layer-union jack-shaped diagonal bracing truss structure, whose cantilever ends are rigidly supported on the cantilever trusses with arc-shaped facades, and form a horizontal integral continuity truss structure; the stay cable supporting structures (FIG. 1*f*) are located between the cantilever portions of the cantilever trusses with arc-shaped facades and the corridor truss structures, and includes stay cable supporting structures in the cantilever corridor truss areas and stay cable supporting structures in the large-span corridor truss area, the top ends of the stay cables of the stay cable supporting structures are suspended at the connection of the connecting trusses at cantilever portions and the cantilever trusses with arc-shaped facades or at the top cantilever ends of the cantilever trusses with arc-shaped facades, the bottom ends of the stay cables of the stay cable supporting structures are obliquely pulled and suspended at cantilever portions and the large-span portion of the corridor truss structures.

As shown in FIGS. 1*b*, 2-5 and 7*a*-7*b*, the cantilever trusses with arc-shaped facades are composed of two sets of ultra-long cantilever trusses with arc-shaped facades and triquetrous planes in an convexity shape, which are arranged symmetrically with respect to a central positioning point 31 and form the main body structure of the two sets of ultra-long cantilever trusses with arc-shaped facades and triquetrous planes in an convexity shape supported on the ground at the bottom; each set of ultra-long cantilever trusses with arc-shaped facades and triquetrous planes is composed of several ultra-long cantilever trusses with arc-shaped facades and triquetrous planes arranged in parallel at a certain distance; each ultra-long cantilever trusses with arc-shaped facades and triquetrous planes is composed of outer chords 1 of the cantilever trusses with arc-shaped facades, inner chords 2 of the cantilever trusses with arc-shaped facades, vertical webs 3 of the cantilever trusses with arc-shaped facades, and diagonal webs 4 of the cantilever trusses with arc-shaped facades. The width of each ultra-long cantilever truss with arc-shaped facades and triquetrous planes has a decreasing shape from a bottom landing end 5 of one of the cantilever trusses with arc-shaped facades to a top cantilever endocorresponding of the cantilever truss with arc-shaped facades, and intersect at point at the top thereof. In this embodiment, each set of ultra-long cantilever trusses with arc-shaped facades and triquetrous planes comprises three ultra-long cantilever trusses with arc-shaped facades and triquetrous planes spaced in parallel.

Figure 1B:
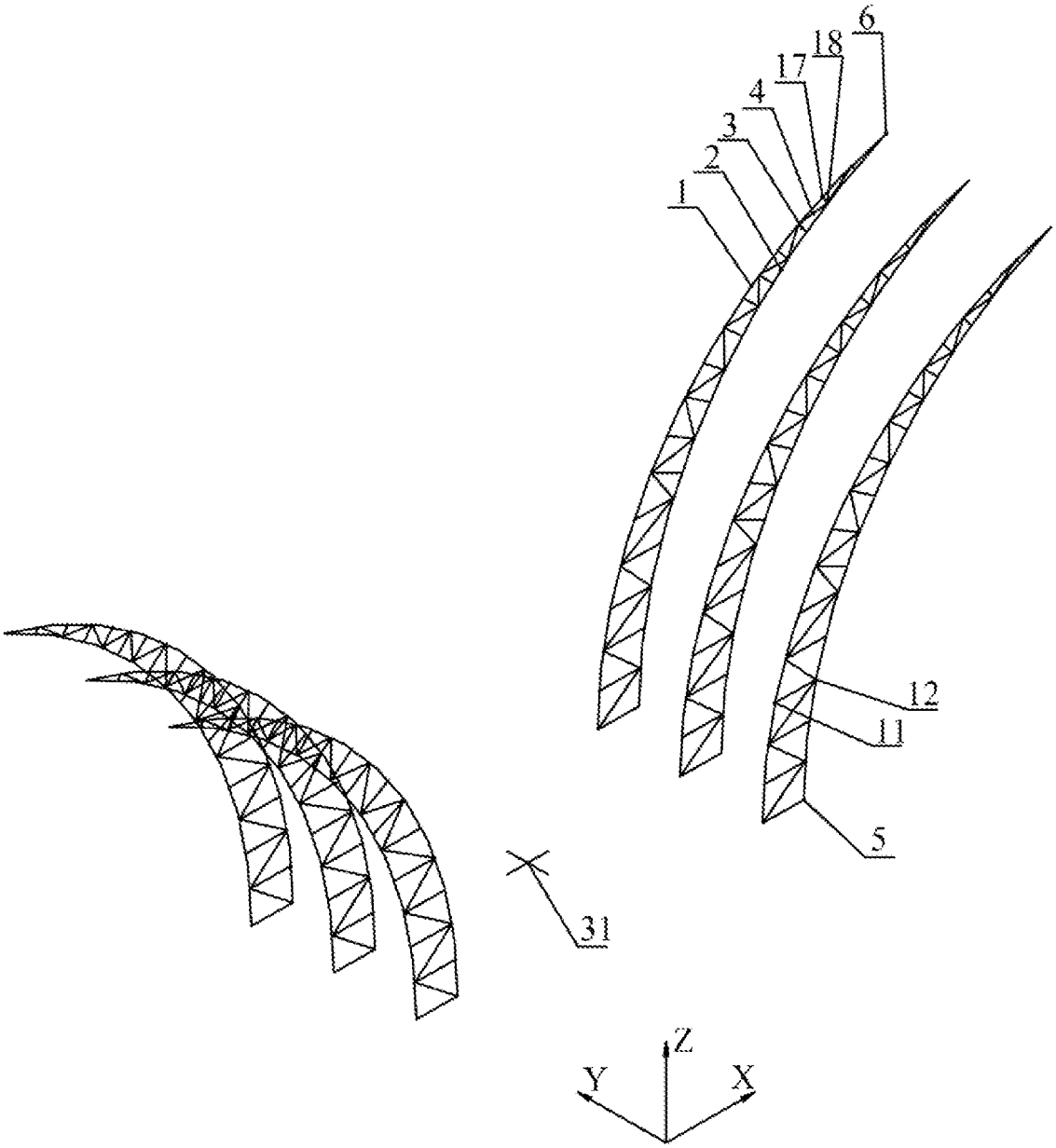
FIG. 1*b* is a schematic diagram of a cantilever trusses with arc-shaped facades of the embodiment of the large-span corridor structure composed of arc-shaped cantilever trusses and stay cable supporting structures according to the present disclosure.
Figure 1C:
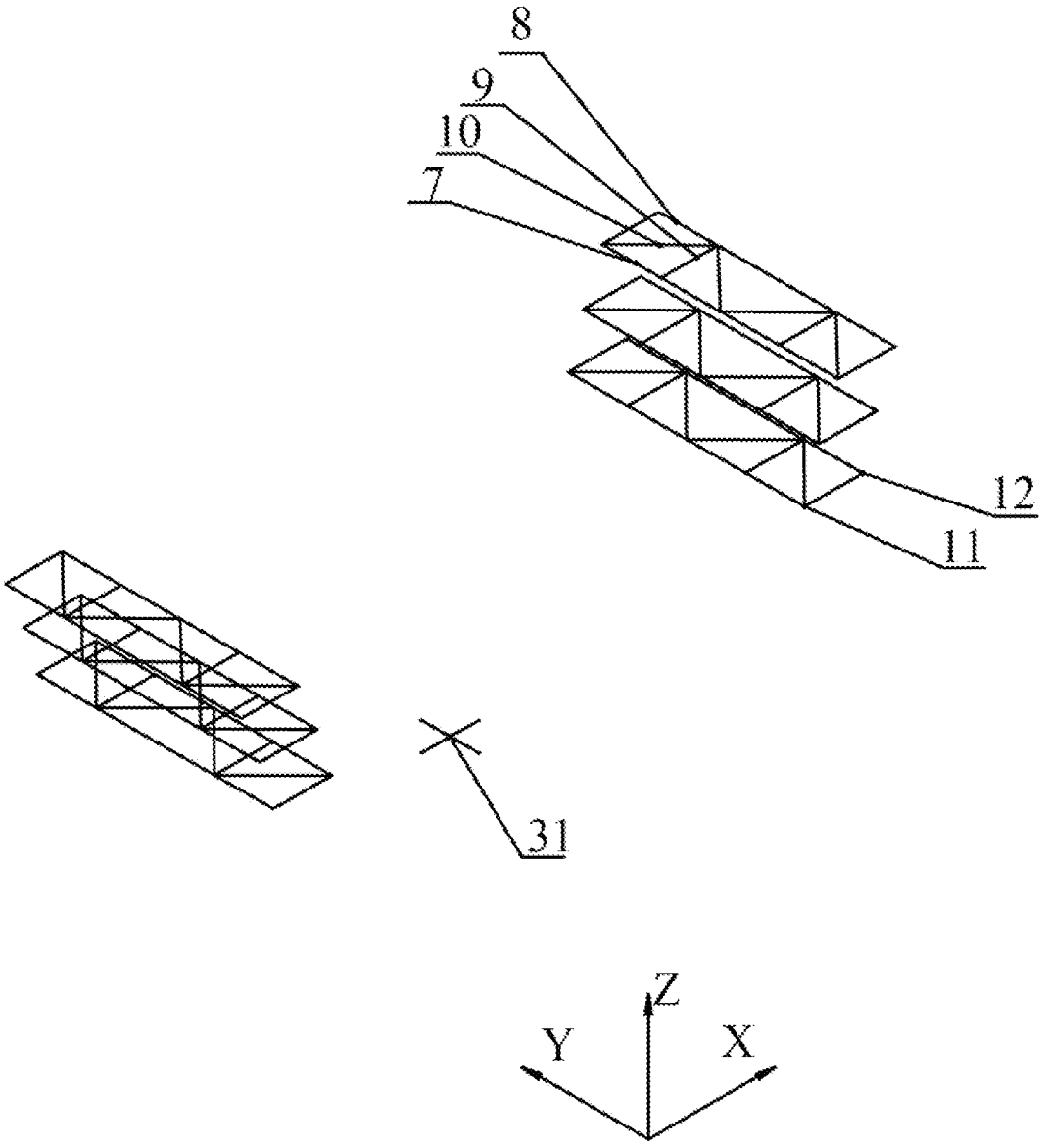
FIG. 1*c* is a schematic diagram of orthogonal connecting trusses at a corridor of the embodiment of the large-span corridor structure composed of arc-shaped cantilever trusses and stay cable supporting structures according to the present disclosure.
Figure 1D:
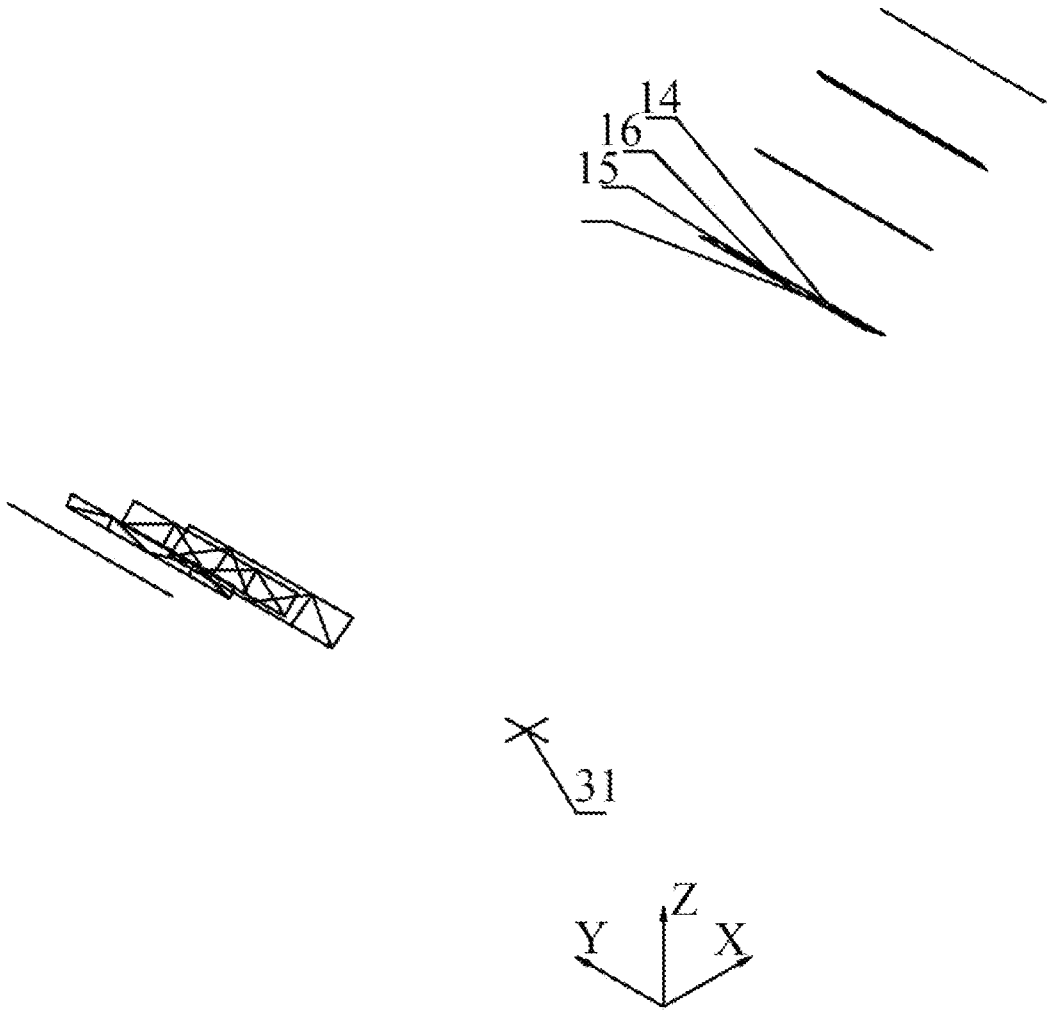
FIG. 1*d* is a schematic diagram of connecting trusses at cantilever portions of the embodiment of the large-span corridor structure composed of arc-shaped cantilever trusses and stay cable supporting structures according to the present disclosure.
Figure 3:
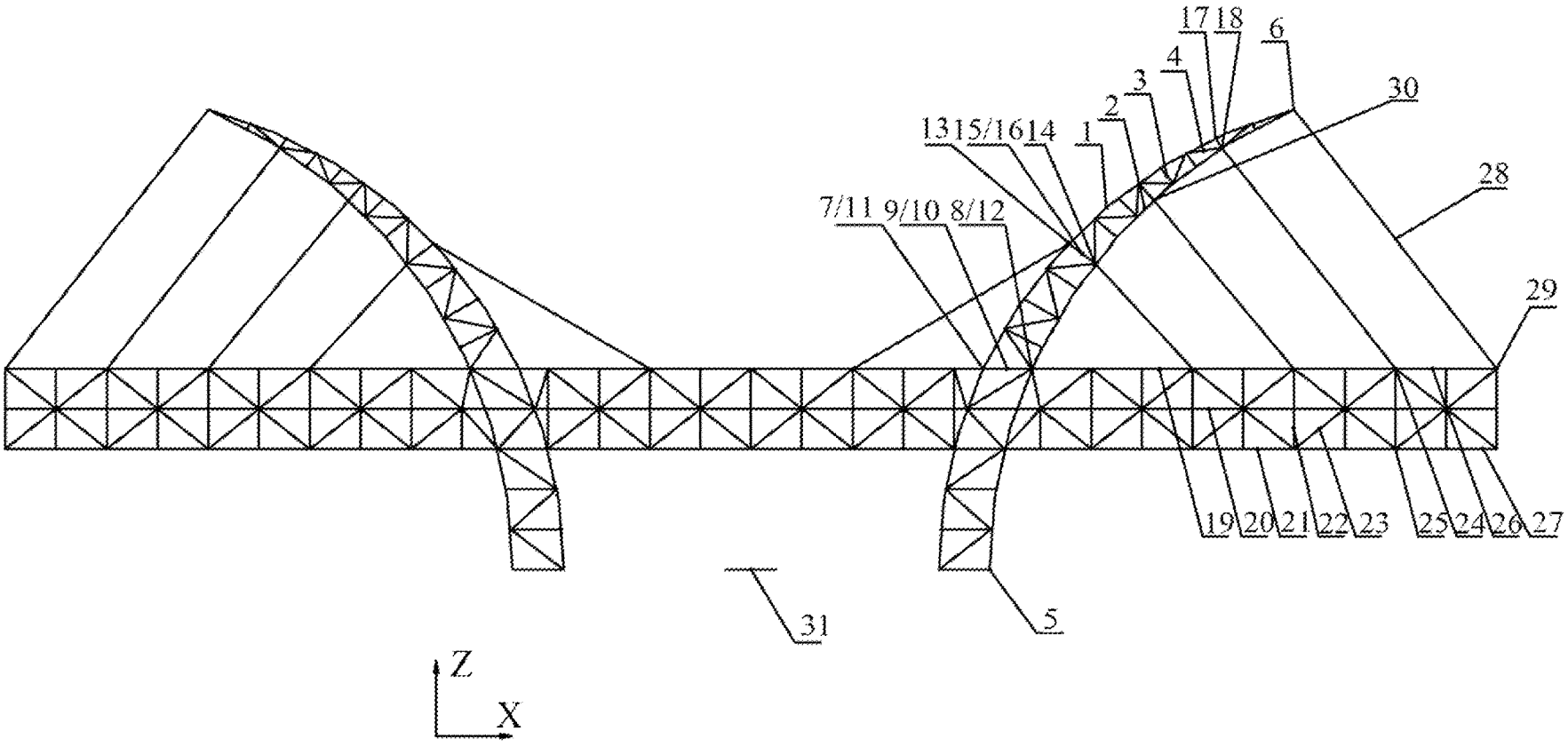
FIG. 3 is a front view of the embodiment of the large-span corridor structure composed of arc-shaped cantilever trusses and stay cable supporting structures according to the present disclosure, that is, a schematic sectional view taken along B-B in FIG. 1*a;*
Figure 4:
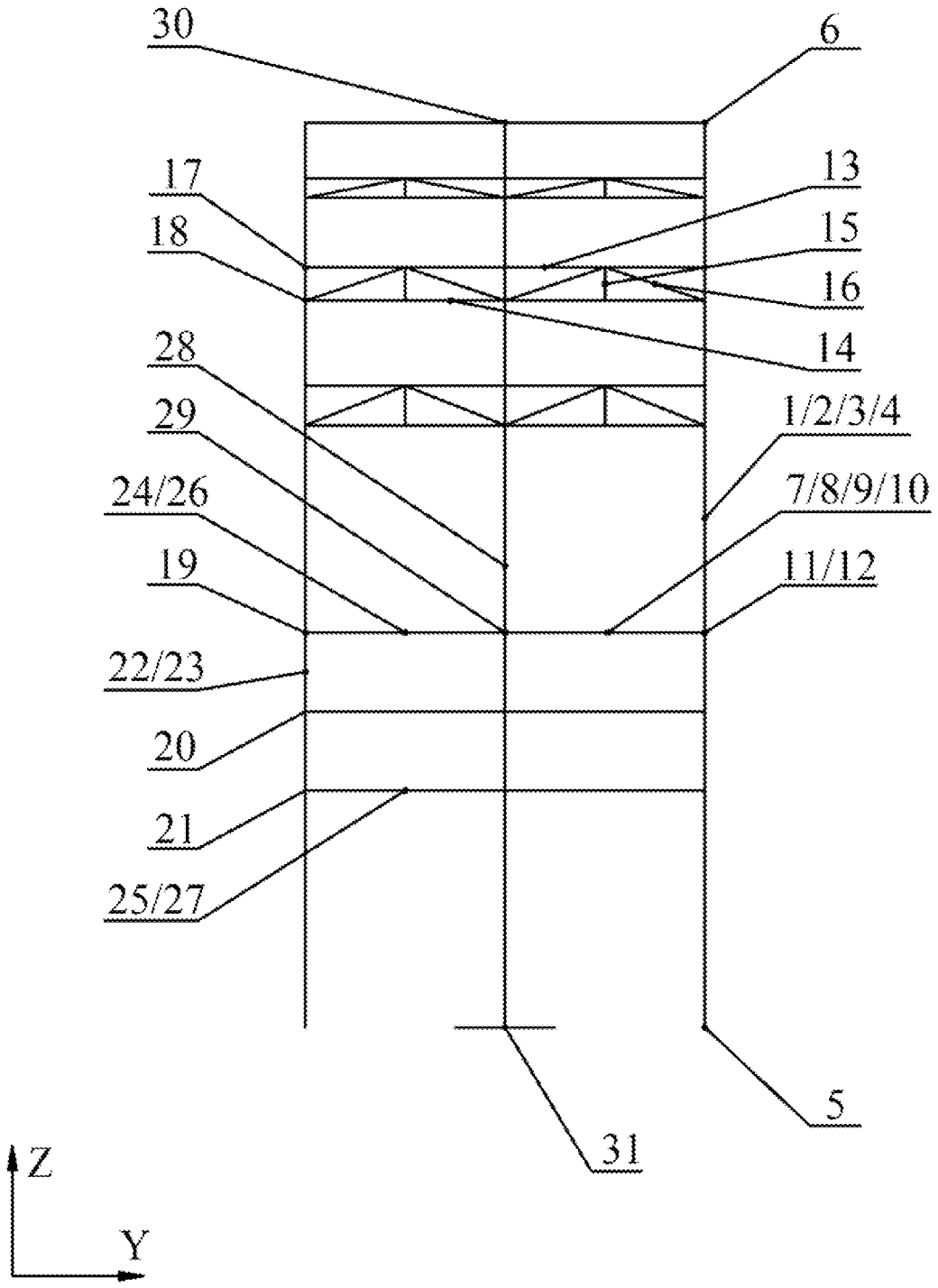
FIG. 4 is a right view of the embodiment of the large-span corridor structure composed of arc-shaped cantilever trusses and stay cable supporting structures according to the present disclosure, that is, a schematic sectional view taken along C-C in FIG. 2.
Figure 5:
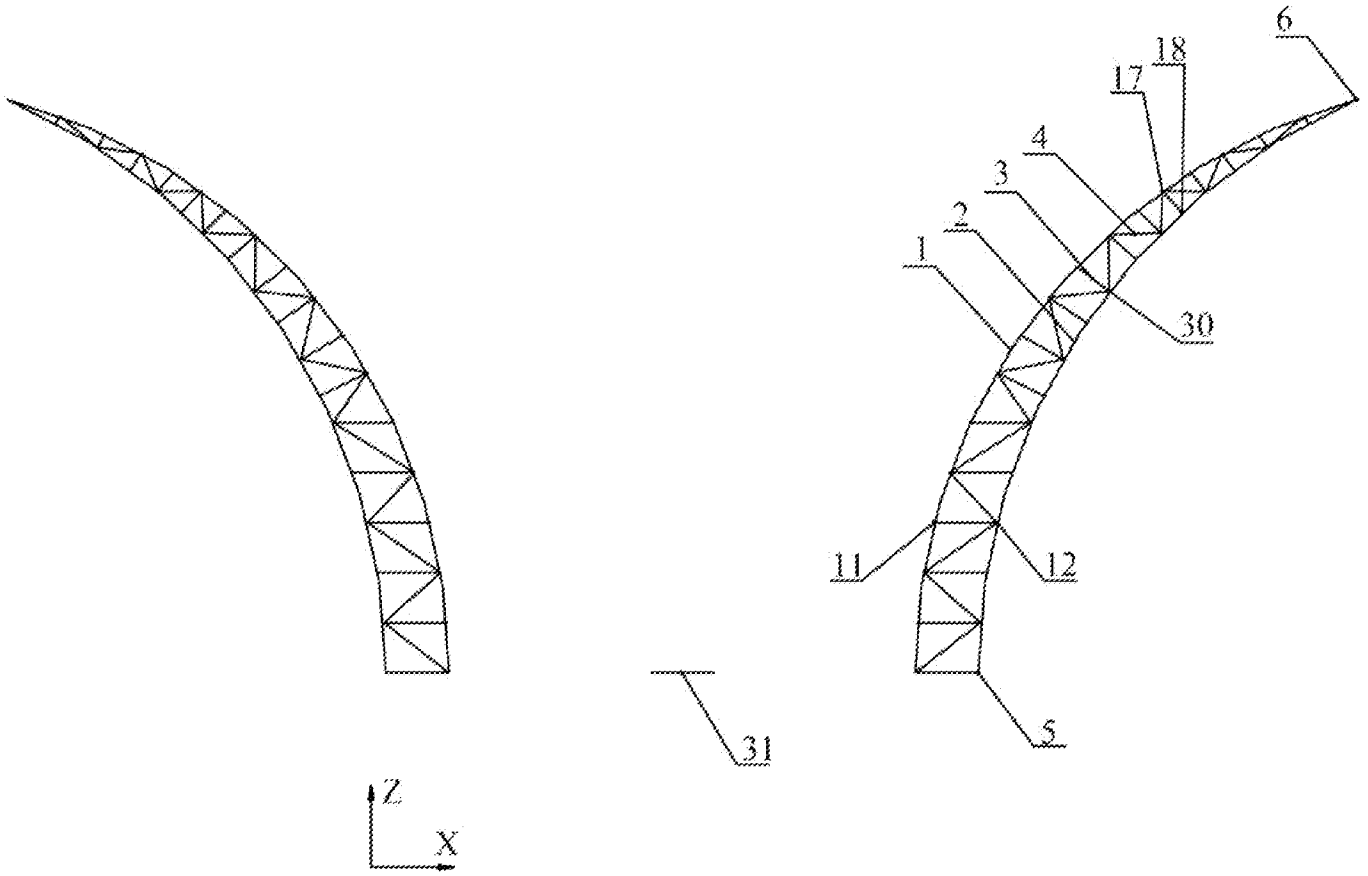
FIG. 5 is a front view of the cantilever trusses with arc-shaped facades of FIG. 1*b;*

As shown in FIGS. 1*b*, 3 and 5, each ultra-long cantilever truss with arc-shaped facades and triquetrous planes is in the form of a planar triangle grid truss and has arc-shaped facades, in which each angle between connecting chord long lines from the bottom landing ends 5 of the cantilever trusses with arc-shaped facades to the top cantilever ends 6 of the cantilever trusses with arc-shaped facades and the horizontal ground is generally 50-80 degrees. The width of each bottom landing end of the cantilever trusses with arc-shaped facades 5 is generally 4-8 m, and the distance between two ultra-long cantilever trusses with arc-shaped facades and triquetrous planes adjacent is generally 8-15 m, the horizontal cantilever length from one of the bottom landing ends to the corresponding top cantilever end is generally 20-50 m, and the height of each ultra-long cantilever truss with arc-shaped facades and triquetrous planes is generally 40-80 m; if the angles between the connecting chord long lines and the horizontal ground are too large, it is difficult to achieve an ultra-long cantilever of the truss with arc-shaped facades, and if the angles are too small, the cantilever corridor building function cannot be achieved; each cross section of the chord members of the ultra-long cantilever trusses with arc-shaped facades and triquetrous planes is a circular pipe with the diameter of generally 600-1500 mm; each cross section of the chord members is of a variable cross section, and decreases gradually from the bottom to the top; each cross section of the web members of the ultra-long cantilever trusses with arc-shaped facades and triquetrous planes is also a circular pipe with the diameter of generally 400-800 mm; When bottom grids of grid trusses with triquetrous planes are too large, the bottom grids can be locally secondary encrypted to strengthen the bottom grids. In this embodiment, the angles between the connecting chord long lines and the horizontal ground is 58 degrees, the width of each bottom landing end 5 of the cantilever trusses with arc-shaped facades is 5 m, the distance between two ultra-long cantilever trusses with arc-shaped facades and triquetrous planes adjacent is 10 m, the horizontal cantilever length from one of the bottom landing ends to the corresponding top cantilever end is 30 m, and the height of each ultra-long cantilever truss with arc-shaped facades and triquetrous planes is 46 m.

As shown in FIGS. 1*c*, 2-4 and 7*a*-7*b*, the orthogonal connecting trusses at the corridor are located between the several ultra-long cantilever trusses with arc-shaped facades and triquetrous planes of each cantilever truss with arc-shaped facades at the height of the corridor, and are in the form of a planar truss with uniform section and is orthogonally arranged with and rigidly connected to the cantilever trusses with arc-shaped facades; the orthogonal connecting trusses at the corridor are corresponded to an upper chord layer, a middle chord layer and a lower chord layer of the corridor truss structures in positions of each cantilever truss with arc-shaped facades, and are in the form of multi-planes truss and symmetrically dual-arranged with respect to the central positioning point 31; each orthogonal connecting truss at the corridor is composed of outer chords 7 of the orthogonal trusses at the corridor, inner chords 8 of the orthogonal trusses at the corridor, vertical webs 9 of the orthogonal trusses at the corridor, and diagonal webs 10 of the orthogonal trusses at the corridor; and the orthogonal connecting trusses at the corridor are rigidly connected to the cantilever trusses with arc-shaped facades and overall carried by outer chord rigid connecting ends 11 of the orthogonal trusses at the corridor and inner chord rigid connecting ends 12 the orthogonal trusses at the corridor. In this embodiment, each cantilever truss with arc-shaped facades is connected to three orthogonal connecting trusses at the corridor.

As shown in FIGS. 1*c* and 2-4, each orthogonal connecting truss at the corridor is in the form of a planar truss with uniform section having the width of generally 3-6 m, and the distance between two orthogonal connecting trusses at the corridor adjacent is generally 4-8 m; the main function of the orthogonal connecting trusses at the corridor is to improve the overall stability of the main body structure of the cantilever trusses with arc-shaped facades; each cross section of the members of the orthogonal connecting trusses at the corridor is a circular pipe, the diameter of each chord is generally 400-800 mm, and the diameter of each web is generally 200-500 mm. In this embodiment, the width of each truss is 4.8 m, and the distance between two orthogonal connecting trusses at the corridor adjacent is 4.2 m.

The cantilever trusses with arc-shaped facades and the orthogonal connecting trusses at the corridor are rigidly connected, and together form a core supporting structure.

As shown in FIGS. 1*d*, 2-4 and 7*a*-7*b*, the connecting trusses at cantilever portions are located between the several ultra-long cantilever trusses with arc-shaped facades and triquetrous planes of each set of cantilever trusses with arc-shaped facades, and are in the form of a planar truss with uniform section and are arranged at a certain distance and orthogonally rigidly connected to the cantilever trusses with arc-shaped facades; the connecting trusses at cantilever portions are symmetrically dual-arranged with respect to the central positioning point 31; each connecting truss at cantilever portions is composed of outer chords 13 of the connecting trusses at cantilever portions, inner chords 14 of the connecting trusses at cantilever portions, vertical webs 15 of the connecting trusses at cantilever portions, and diagonal webs 16 of the connecting trusses at cantilever portions. The connecting trusses at cantilever portions are rigidly connected to the cantilever trusses with arc-shaped facades and overall carried by outer chord rigid connecting ends 17 of the connecting trusses at cantilever portions and inner chord rigid connecting ends 18 of the connecting trusses at cantilever portions. In this embodiment, each cantilever truss with arc-shaped facades is connected to four connecting trusses at cantilever portions, in which the top portion of each connecting truss at cantilever portions is weakened into a single connecting steel beam so as to correspond to a junction point where the top cantilever end 6 of each cantilever truss with arc-shaped facades is connected.

As shown in FIGS. 1*d* and 2-4, each connecting truss at cantilever portions is in the form of a planar truss with uniform section having a width generally 1-4 m, and the width is same as the width at a position corresponding to the cantilever trusses with arc-shaped facades, and the distance between adjacent connecting trusses at cantilever portions is generally 8-14 m; The main function of the connecting truss at cantilever portions is to serve as an upper end fixing positions of the stay cables of the stay cable supporting structures, which have stronger deformation rigidity and force carrying performance, and also serve as a lateral support for the cantilever portions of the cantilever trusses with arc-shaped facades and form an overall lateral force resistance rigidity; each cross section of the members of the connecting trusses at cantilever portions is a circular pipe, the diameter of each chord is generally 300-600 mm, and the diameter of each web is generally 200-400 mm. In this embodiment, except that the top cantilever end of each cantilever truss with arc-shaped facades are a single connecting steel beam, the widths of the three trusses from bottom to top is 3.3 m, 2.3 m and 1.2 m, respectively, and the spaces between three adjacent connecting trusses at cantilever portions from bottom to top is 8.5 m, 8.5 m and 8.0 m, respectively.

As shown in FIGS. 1*e*, 2-3, 6*a*-6*b* and 7*a*-7*b*, the corridor truss structures are composed of a middle large-span corridor truss area located between the two sets of cantilever trusses with arc-shaped facades, and two cantilever corridor truss areas on both sides located outside the two sets of cantilever trusses with arc-shaped facades; the number of the corridor truss structures is same as the number of the ultra-long cantilever trusses with arc-shaped facades and triquetrous planes of each set of cantilever trusses with arc-shaped facades, and the corridor truss structures are composed of several double-layer trusses arranged in a longitudinal direction; each corridor truss structure is composed of upper chords 19 of the corridor truss structures, middle chords 20 of the corridor truss structures, lower chords 21 of the corridor truss structures, vertical webs 22 of the corridor truss structures and diagonal webs 23 of the corridor truss structures, which form a double-layer-union jack-shaped diagonal bracing truss structure; each corridor truss structures is a double-layer high-rise or common roof floor structure; roof connecting steel beams 24 of the corridor truss structures and floor connecting steel beams 25 of the corridor truss structures are respectively arranged on the roof and the floor of the corridor truss structures and are rigidly connected to each corridor truss structure to form a vertical floor load bearing system. By means of welding matching joints of stiffeners 32 of steel truss joint additionally provided at the intersections of the diagonal webs of the corridor truss structures, the bearing force of the joints is improved. In this embodiment, the corridor truss structures are composed of the double-layer trusses arranged longitudinally.

Figure 1E:
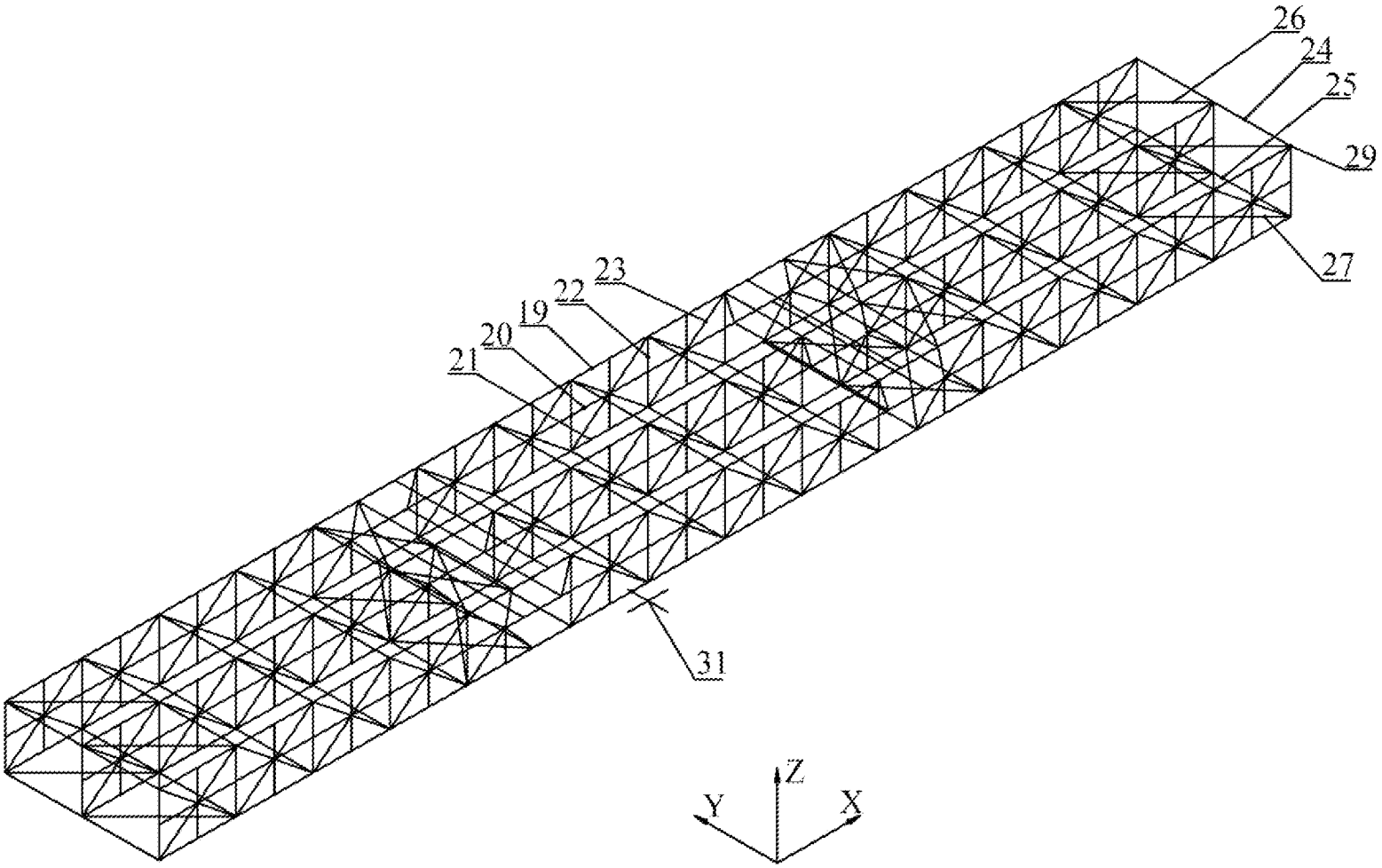
FIG. 1*e* is a schematic diagram of corridor truss structures of the embodiment of the large-span corridor structure composed of arc-shaped cantilever trusses and stay cable supporting structures according to the present disclosure.
Figure 1F:
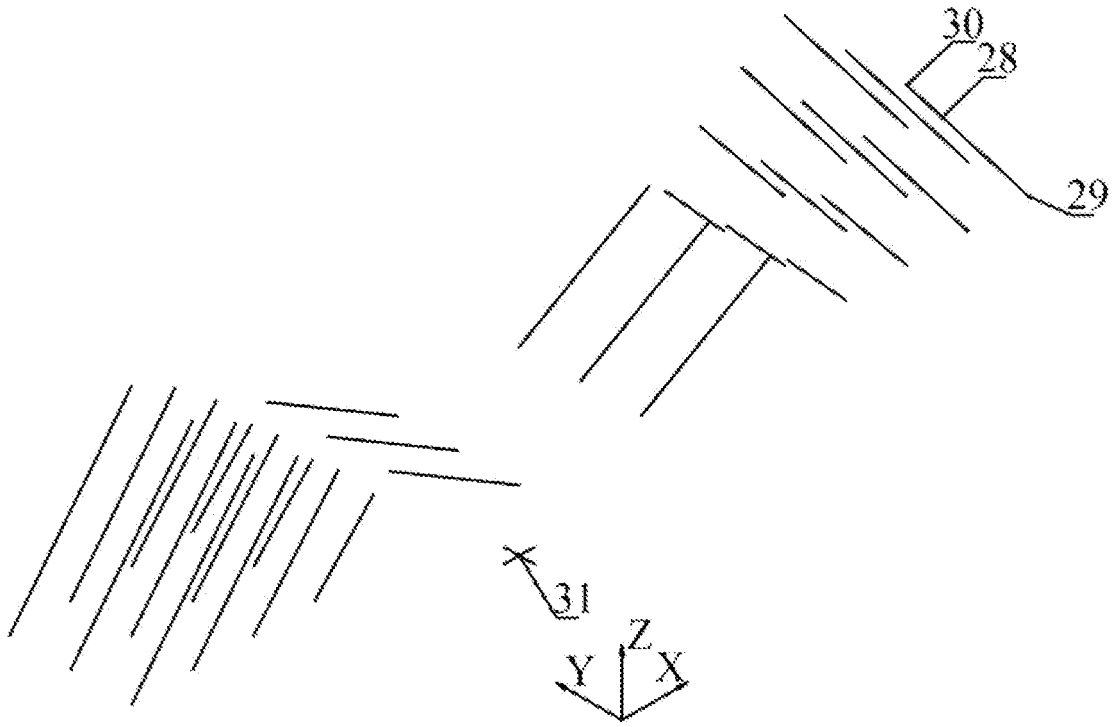
FIG. 1*f* is a schematic diagram of stay cable supporting structures of the embodiment of the large-span corridor structure composed of arc-shaped cantilever trusses and stay cable supporting structures according to the present disclosure.
Figure 2:
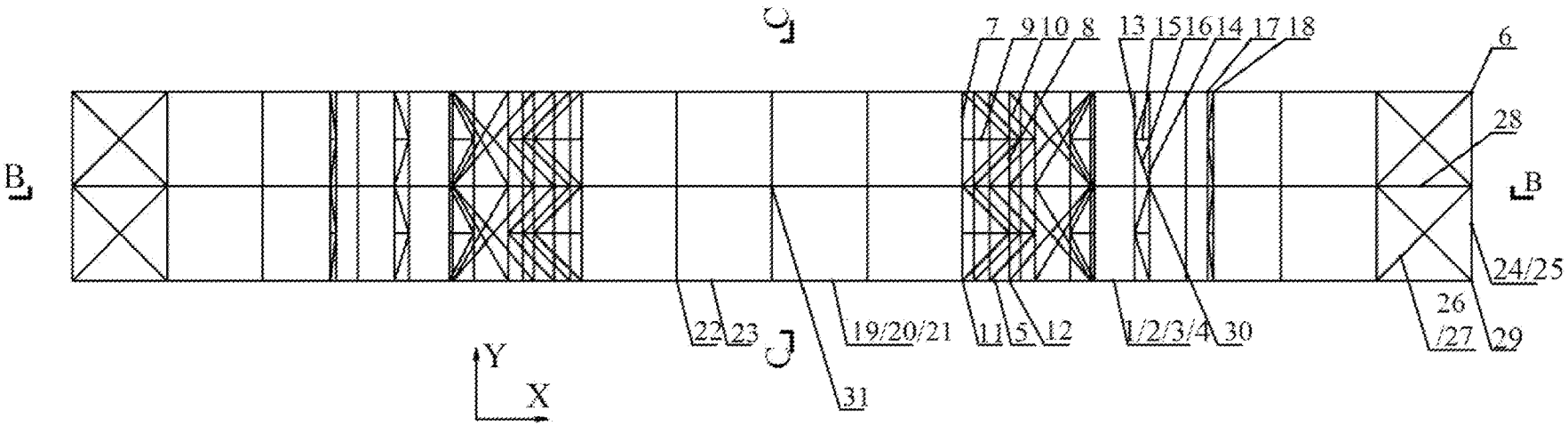
FIG. 2 is a plan view of the embodiment of the large-span corridor structure composed of arc-shaped cantilever trusses and stay cable supporting structures according to the present disclosure, that is, a schematic sectional view taken along A-A in FIG. 1*a;*
Figure 6A:
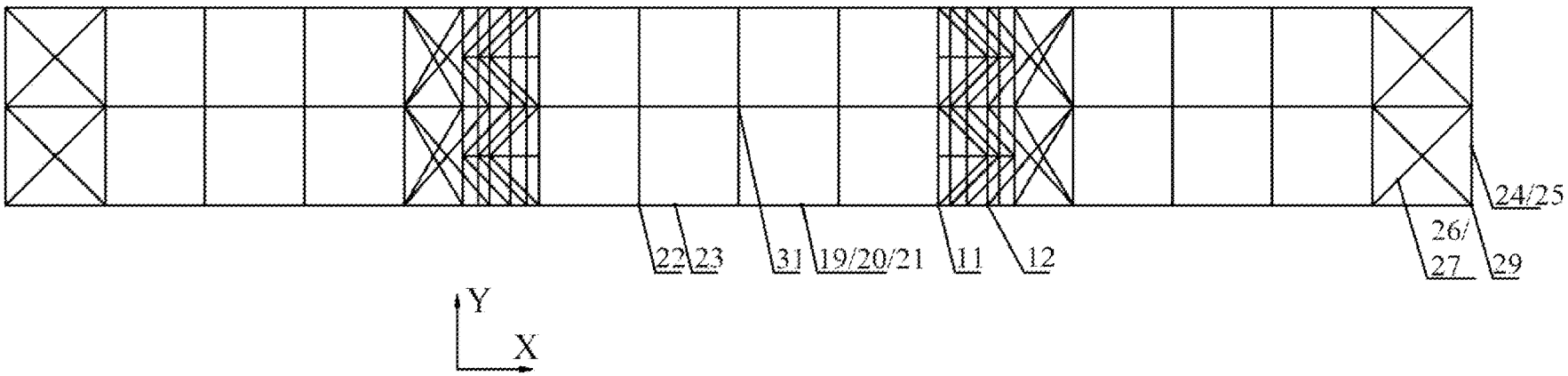
FIG. 6*a* is a plan view of the corridor truss structures of FIG. 1*e;*
Figure 6B:
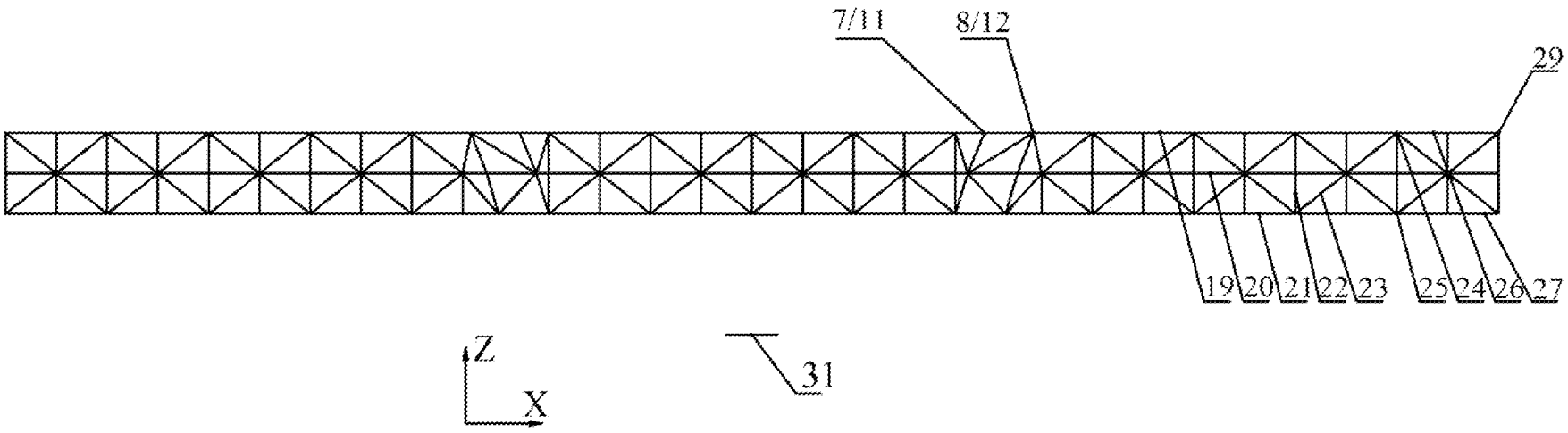
FIG. 6*b* is a front view of the corridor truss structures of FIG. 1*e;*
Figure 7A:
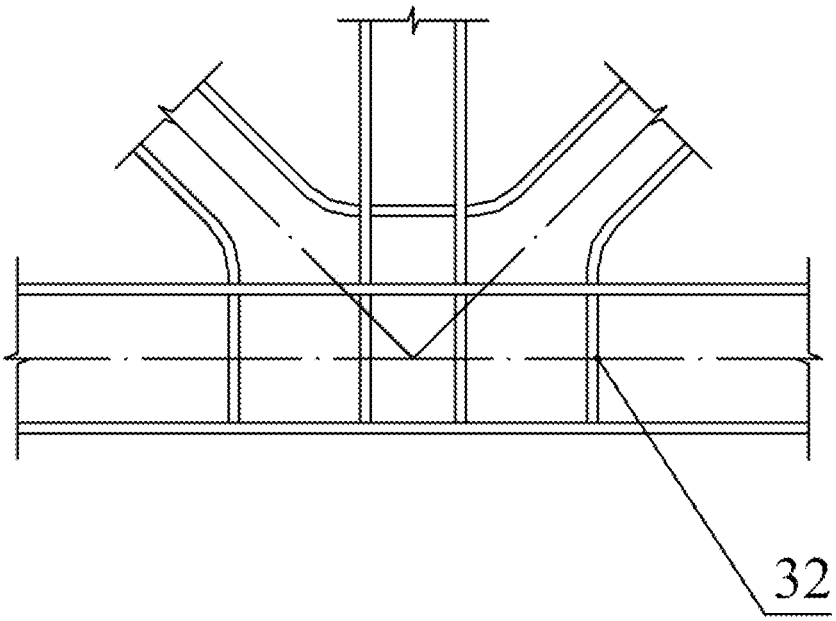
FIG. 7*a* is a structure schematic diagram of a steel truss joint when there are vertical webs in the cantilever trusses with arc-shaped facades in FIG. 1*b*, the orthogonal connecting trusses at a corridor in FIG. 1*c*, the connecting trusses at cantilever portions in FIG. 1*d* and corridor truss structures in FIG. 1*e;*
Figure 7B:
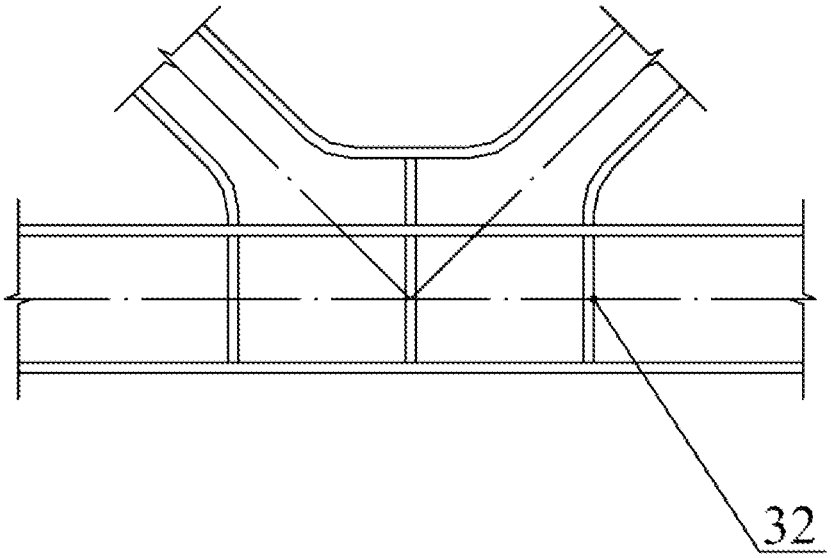
FIG. 7*b* is a structure schematic diagram of a steel truss joint when there are not vertical webs in the cantilever trusses with arc-shaped facades in FIG. 1*b*, the orthogonal connecting trusses at a corridor in FIG. 1*c*, the connecting trusses at cantilever portions in FIG. 1*d* and corridor truss structures in FIG. 1*e;*
Figure 8A:
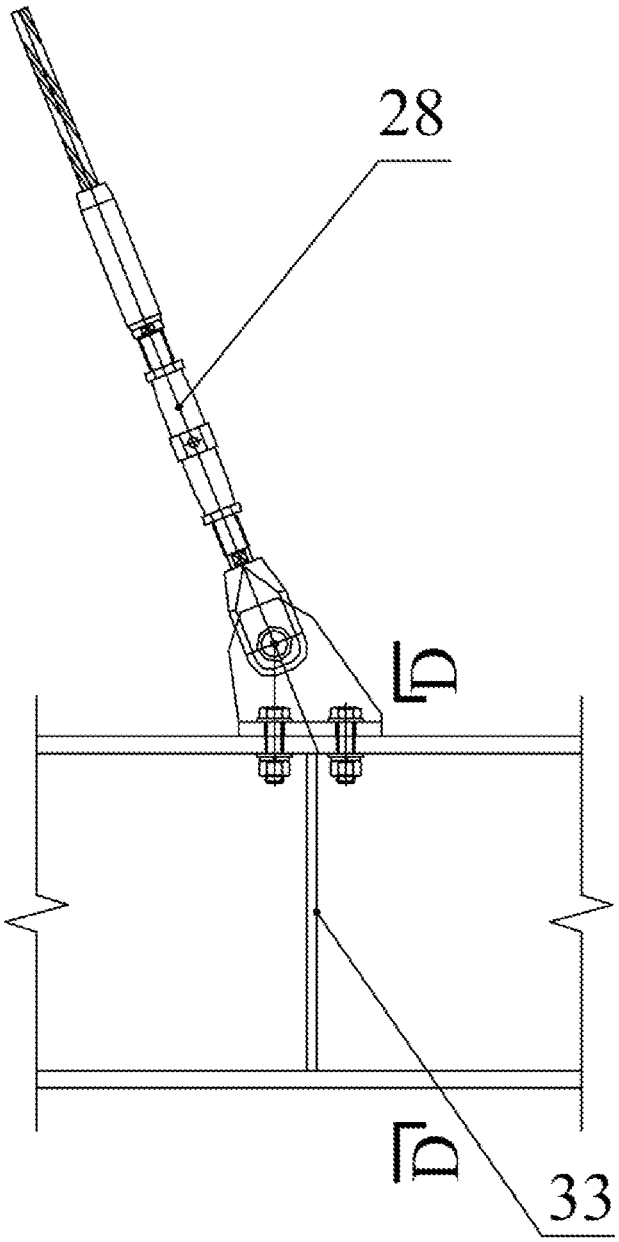
FIG. 8*a* is a structure schematic diagram of joint projection of suspending ends of the stay cable supporting structures in FIG. 1*f* along a direction of a truss steel beam.
Figure 8B:
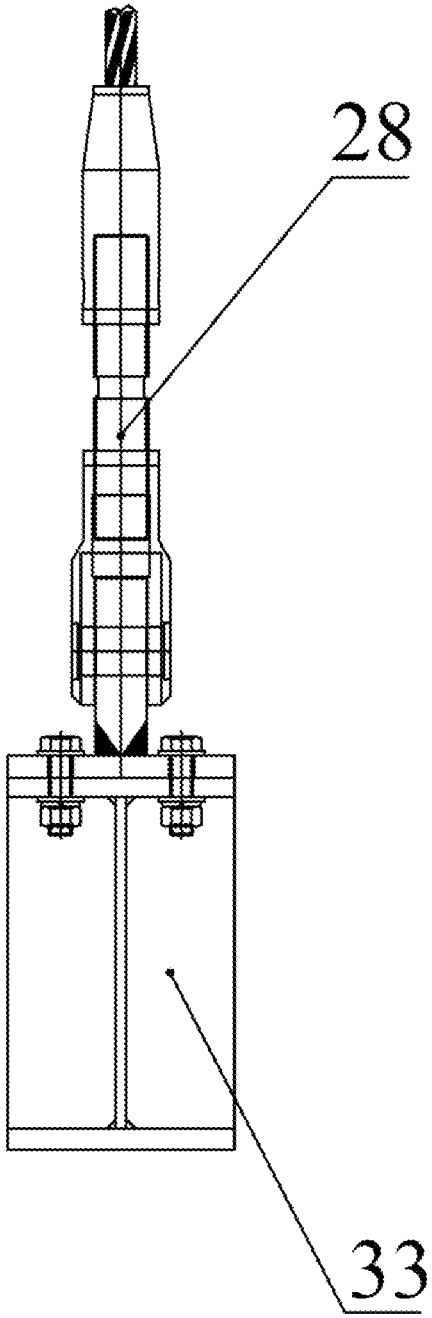
FIG. 8*b* is a structure schematic diagram (namely, a schematic sectional view taken along D-D in FIG. 8*a*) of joint projection of suspending ends of the stay cable supporting structures in FIG. 1*f* along a direction orthogonal to the truss steel beam.

As shown in FIGS. 1*e*, 3 and 6*b*, both ends of the middle large-span corridor truss area are rigidly supported on the outer chord rigid connecting ends 11 of the orthogonal connecting trusses at the corridor (the large-span supporting ends of the corridor truss structures), the cantilever ends of the cantilever corridor truss area on both sides are rigidly supported on the inner chord rigid connecting ends 12 of the orthogonal connecting trusses at the corridor (the cantilever supporting ends of the corridor truss structures), thereby forming a horizontal integral continuity truss structure; roof horizontal stay cables 26 of the corridor truss structures and floor horizontal stay cables 27 of the corridor truss structures are respectively arranged on the roof and the floor of the corridor truss structures, so as to improve the in-plane torsional rigidity of the corridor truss structures itself; the bottoms of cantilever corridor truss area on both sides are not supported, and are of a single cantilever structure, and are carried and suspended by the stay cable supporting structures.

As shown in FIGS. 1*e*, 2-3, and 6*a*-6*b*, each corridor truss structure is in the form of a planar truss with uniform section, the single-layer height of each corridor truss structure is generally 4-5 m, the corresponding double-layer height is 8-10 m, and the space between two corridor truss structures adjacent is generally 8-15 m; each cross section of members of the upper chords 19 of the corridor truss structures, the middle chords 20 of the corridor truss structures and the lower chords 21 of the corridor truss structures is a box-shaped cross section with a height of generally 600-800 mm; each cross section of members of the vertical webs 22 of the corridor truss structures and the diagonal webs 23 of the corridor truss structures is a box-shaped cross section with a height of generally 300-500 mm; each cross section of members of the roof connecting steel beams 24 of the corridor truss structures and the floor connecting steel beams 25 of the corridor truss structures is a H-shaped cross section with a height of generally 400-600 mm; each cross-section of members of the roof horizontal stay cable 26 of corridor truss structures and the floor horizontal stay cable 27 of corridor truss structures is a H-shaped cross section or a solid steel strut. In this embodiment, the single-layer height of each corridor truss structure is 4 m, the corresponding double-layer height is 8 m, and the distance between the two corridor truss structures adjacent is 10 m.

As shown in FIGS. 1*f*, 2-4, and 8*a*-8*b*, the stay cable supporting structures are composed of multiple sets of stay cables 28 of the stay cable supporting structures, and located above the cantilever corridor truss areas on both sides and the middle large-span corridor truss area, wherein top suspending ends 30 of the stay cable supporting structures located above the cantilever corridor truss areas on both sides are respectively located at the top cantilever ends 6 of cantilever trusses with arc-shaped facades and the inner chords 14 of connecting trusses at cantilever portions, and the stay cable supporting structures are multiple sets of stay cable supporting structures. In order to counteract the tension effect of the stay cable supporting structures located above the cantilever corridor truss areas, and increase the span of the middle large-span corridor truss area at the same time, a stay cable supporting structure is added to the middle large-span corridor truss area whose top suspending ends 30 of the stay cable supporting structure is located at the outer chords 13 of the connecting trusses at cantilever portions.

As shown in FIGS. 1*f*, 3, and 8*a*-8*b*, the bottom suspending ends 29 of the stay cable supporting structures are located at joints of the upper chords 19 of the corridor truss structures; the stay cables of the corridor truss structures is obliquely stretched and arranged, and the bottom ends of the stay cables hook cantilever portions and large-span portions of the corridor truss structure, so that the cantilever length of each corridor truss structure is sufficient to satisfy the building function requirements; the ends of the stay cables are hinged and connected using column hinge joints, and the upper chords 19 of the corridor truss structures at joints are provided with stiffeners 33 of stay cable end joints for reinforcement. In this embodiment, the cantilever truss areas on both sides and the middle large-span corridor truss area are respectively composed of four sets of the stay cable supporting structures and one set of the stay cable supporting structures.

As shown in FIGS. 1*f*, 3, and 8*a*-8*b*, each member of the stay cables is a solid steel strut, and the diameter of each cross section of the members of the stay cables is generally 60-150 mm; the angle of inclination of each stay cable is generally between 15 degrees-45 degrees.

The planar truss form composition and the angle of each chord long line of the cantilever trusses with arc-shaped facades, the number of sets of the members and the planar truss form of the orthogonal connecting trusses at the corridor, the number and distance of the connecting trusses at cantilever portions, the number of layers and the diagonal web form of the corridor truss structures, and the number of sets of the members and stayed form of the stay cable supporting structures can all be appropriately adjusted based on the requirements of building model, functional space, large span, cantilever span and boundary conditions, which do not influence the composition and construction manner of each member of the large-span corridor structure composed of arc-shaped cantilever trusses and stay cable supporting structures.

Embodiment 2

Figure 9:
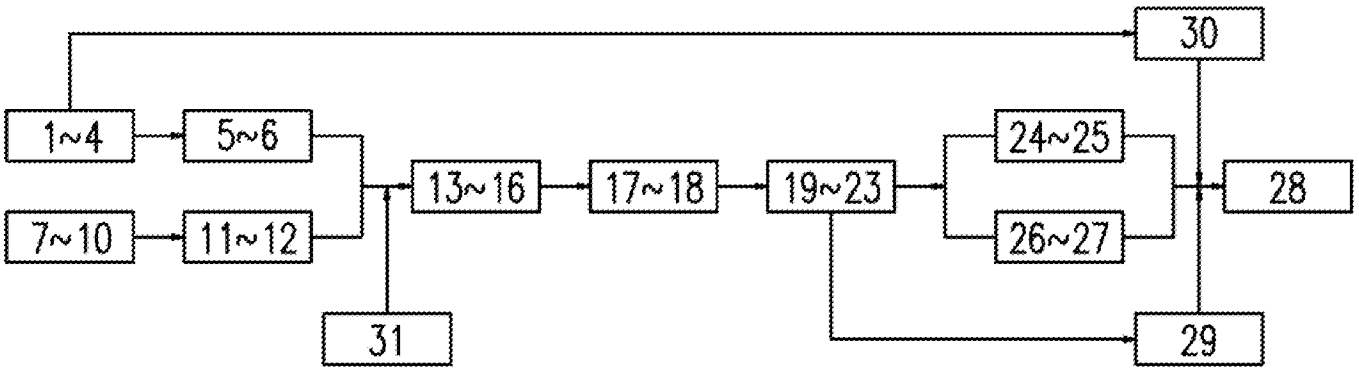
FIG. 9 is a constituting flowchart of the embodiment of the large-span corridor structure composed of arc-shaped cantilever trusses and stay cable supporting structures according to the present disclosure.

This embodiment of the present disclosure provides a constituting method of a large-span corridor structure composed of arc-shaped cantilever trusses and stay cable supporting structures. Referring to FIG. 9, the constituting method includes the following steps:

S1. constituting two sets of cantilever trusses with arc-shaped facades using outer chords of the cantilever trusses with arc-shaped facades 1, inner chords 2 of the cantilever trusses with arc-shaped facades, vertical webs 3 of the cantilever trusses with arc-shaped facades, and diagonal webs 4 of the cantilever trusses with arc-shaped facades, the two sets of the cantilever trusses with arc-shaped facades are symmetrically arranged at both sides based on a central positioning point 31, and bottoms of the cantilever trusses with arc-shaped facades are landing supported at bottom landing ends 5 of the cantilever trusses with arc-shaped facades, the tops of the cantilever trusses with arc-shaped facades are cantilevered to top cantilever ends 6 of cantilever trusses with arc-shaped facades to form a main body structure of the two sets of the cantilever trusses with arc-shaped facades landing fixedly supported;

S2. constituting orthogonal connecting trusses at the corridor in a form of planar truss using outer chords 7 of the orthogonal connecting trusses at the corridor, inner chords 8 of the orthogonal connecting trusses at the corridor, vertical webs 9 of the orthogonal connecting trusses at the corridor and diagonal webs 10 of the orthogonal connecting trusses at the corridor;

S3. arranging orthogonally the main body structure of the cantilever trusses with arc-shaped facades generated in S1 and the orthogonal connecting trusses at the corridor generated in S2, and connecting rigidly outer chord rigid connecting ends 11 of the orthogonal connecting trusses at the corridor to inner chord rigid connecting ends 12 of the orthogonal connecting trusses at the corridor, so as to form a core support framework together;

S4. constituting connecting trusses at cantilever portions using outer chords 13 of the connecting trusses at cantilever portions, inner chords 14 of the connecting trusses at cantilever portions, vertical webs 15 of the connecting trusses at cantilever portions and diagonal webs 16 of the connecting trusses at cantilever portions;

S5. connecting rigidly the connecting trusses at cantilever portions generated in S4 through cantilever portions of each set of the cantilever trusses with arc-shaped facades to outer chord rigid connecting ends 17 of the connecting trusses at cantilever portions and inner chord rigid connecting ends 18 of the connecting trusses at cantilever portions, so as to form an integral structure of high lateral force resistance rigidity and torsional rigidity;

S6. constituting each corridor truss structure using upper chords 19 of the corridor truss structures, middle chords 20 of the corridor truss structures, lower chords 21 of the corridor truss structures, vertical webs 23 of the corridor truss structures and diagonal webs of the corridor truss structures;

S7. connecting every corridor truss structure generated in S6 by roof connecting steel beams 24 of the corridor truss structures and floor connecting steel beams 25 of the corridor truss structures, so as to form the corridor truss structures, and enhancing corridor truss structures by stiffeners 32 of steel truss joints at intersections of the diagonal webs 23 of the corridor truss structures;

S8. improving in-plane torsional rigidity of the corridor truss structures generated in S7 by roof horizontal stay cables 26 of the corridor truss structures and floor horizontal stay cables 27 of the corridor truss structures;

S9. large-span supporting ends of the corridor truss structures is the outer chord rigid connecting ends 11 of the orthogonal connecting trusses at the corridor; cantilever supporting ends of the corridor truss structures is the inner chord rigid connecting ends 12 of the orthogonal connecting trusses at the corridor;

S10. connecting bottom ends 28 of stay cables of the stay cable supporting structures to bottom suspending ends 29 of the stay cable supporting structures at joints of the upper chords 19 of the corridor truss structures; connecting top ends 28 of the stay cables of the stay cable supporting structures to the top cantilever ends 6 of the cantilever trusses with arc-shaped facades, the inner chords 14 of the connecting trusses at cantilever portions, or top suspending ends 30 of the stay cable supporting structures at the outer chords 13 of the connecting trusses at cantilever portions, enhancing the upper chords 19 of the corridor truss structures at joints of connecting ends of the stay cables by the stiffeners 33 of the stay cable end joints.

Embodiment 3

The Embodiment 3 of the present disclosure provides an application of the large-span corridor structure composed of arc-shaped cantilever trusses and stay cable supporting structures in carrying and system design of a complexity large-span steel corridor truss structure of the composite building model with bottom large-span space long cantilever on both sides and top stay cable supporting, the long cantilever means that the maximum cantilever length of the structure is not less than 50 m, and the large-span means that the maximum space span of the structure is not less than 100 m.

Compared with the disadvantages of the prior art, the large-span corridor structure composed of arc-shaped cantilever trusses and stay cable supporting structures provided by the present disclosure can achieve the functions and composite building model with bottom large-span space long cantilever support on both sides and stay cable supporting and top stay cable supporting based on the supporting truss core system composed of the cantilever trusses with arc-shaped facades and the orthogonal truss at the corridor, the performance of lateral force resistance and torsion resistant of the overall structure can be enhanced by the connecting trusses at cantilever portions, and the bottom large-span space long cantilever corridor truss structures on both sides and cantilever portions thereof can be stayed and suspended by the corridor truss structures and the stay cable supporting structure that form integral force model. The system has specific member modules, clear force transmission and complies with the design principles of the overall bearing and carrying mode and can achieve the carrying and system design of a complexity large-span steel corridor truss structure of the composite building model with bottom large-span space long cantilever support on both sides and top stay cable supporting. Based on carrying performance analysis, and by overall performance control such as member stress, the deformation rigidity, the torsion period and the self-oscillation frequency, the present disclosure can further ensure the advantages of the functions and composite building model with bottom large-span space long cantilever support on both sides, high carrying, high lateral force resistance and stay cable supporting and top stay cable supporting.

What is claimed is:

1. A large-span corridor structure composed of arc-shaped cantilever trusses and stay cable supporting structures, comprising cantilever trusses with arc-shaped facades, orthogonal connecting trusses at a corridor, connecting trusses at cantilever portions, corridor truss structures, and stay cable supporting structures;

wherein the cantilever trusses with arc-shaped facades are composed of two sets of ultra-long cantilever trusses with arc-shaped facades and triquetrous planes wherein the two sets of ultra-long cantilever trusses with arc-shaped facades and triquetrous planes are fixedly supported by ground and symmetrical, and each are formed of several ultra-long cantilever trusses with arc-shaped facades and triquetrous planes arranged in parallel at a certain distance;

the orthogonal connecting trusses at the corridor are located between the several ultra-long cantilever trusses with arc-shaped facades and triquetrous planes of each cantilever truss with arc-shaped facades at a height of the corridor of each set of ultra-long cantilever trusses with arc-shaped facades, and is in the form of a planar truss and is orthogonally arranged with and rigidly connected to the cantilever trusses with arc-shaped facades;

the connecting trusses at cantilever portions are located between the several ultra-long cantilever trusses with arc-shaped facades and triquetrous planes and are in the form of a planar truss, and are arranged at a certain distance and orthogonally rigidly connected to the ultra-long cantilever trusses with arc-shaped facades and triquetrous planes;

the corridor truss structures are composed of a middle large-span corridor truss area and cantilever corridor truss areas on both sides, and are in the form of a double-layer-union jack-shaped diagonal bracing truss structure, whose cantilever ends are rigidly supported on the cantilever trusses with arc-shaped facades, and form a horizontal integral continuity truss structure; and the stay cable supporting structures are located between the cantilever portions of the cantilever trusses with arc-shaped facades and the corridor truss structures, and includes stay cable supporting structures in the cantilever corridor truss areas and stay cable supporting structures in the large-span corridor truss area, top ends of stay cables of the stay cable supporting structures are suspended at a connection of the connecting trusses at cantilever portions and the cantilever trusses with arc-shaped facades or at top cantilever ends of the cantilever trusses with arc-shaped facades, bottom ends of the stay cables of the stay cable supporting structures are connected at cantilever portions and large-span portion of the corridor truss structures.

2. The large-span corridor structure composed of arc-shaped cantilever trusses and stay cable supporting structures according to claim 1, wherein the cantilever trusses with arc-shaped facades are composed of two sets of ultra-long cantilever trusses with arc-shaped facades and triquetrous planes in an inner convexity shape and form a main body structure of the two sets of ultra-long cantilever trusses with arc-shaped facades and triquetrous planes with fixed support on the ground;

each ultra-long cantilever trusses with arc-shaped facades and triquetrous planes is composed of outer chords of the cantilever trusses with arc-shaped facades, inner chords of the cantilever trusses with arc-shaped facades, vertical webs of the cantilever trusses with arc-shaped facades, and diagonal webs of the cantilever trusses with arc-shaped facades; and a width of each ultra-long cantilever truss with arc-shaped facades and triquetrous planes has a decreasing shape from a bottom landing end of one of the cantilever trusses with arc-shaped facades to a top cantilever end corresponding of the cantilever truss with arc-shaped facades, and intersect at point at a top thereof.

3. The large-span corridor structure composed of arc-shaped cantilever trusses and stay cable supporting structures according to claim 2, wherein each ultra-long cantilever truss with arc-shaped facades and triquetrous planes is in the form of a planar triangle grid truss and has arc-shaped facades, each angle between connecting chord long lines from the bottom landing ends of the cantilever trusses with arc-shaped facades to the top cantilever ends of the cantilever trusses with arc-shaped facades and horizontal ground is 50-80 degrees, a width of each bottom landing end of the cantilever trusses with arc-shaped facades is 4-8 m, and distance between two ultra-long cantilever trusses with arc-shaped facades and triquetrous planes adjacent is 8-15 m, a horizontal cantilever length from one of the bottom landing ends of the cantilever trusses with arc-shaped facades to the corresponding top cantilever end of the cantilever trusses with arc-shaped facades is 20-50 m, and a height of each ultra-long cantilever truss with arc-shaped facades and triquetrous planes is 40-80 m;

each cross section of the outer chords of the cantilever trusses with arc-shaped facades and inner chords of the cantilever trusses with arc-shaped facades is a circular pipe with a diameter of 600-1500 mm; and each cross section of the vertical webs of the cantilever trusses with arc-shaped facades and diagonal webs of the cantilever trusses with arc-shaped facades is a circular pipe with a diameter of 400-800 mm.

4. The large-span corridor structure composed of arc-shaped cantilever trusses and stay cable supporting structures according to claim 1, wherein each orthogonal connecting trusses at the corridor is in the form of a planar truss with uniform section and is orthogonally arranged with and rigidly connected to the cantilever trusses with arc-shaped facades;

the orthogonal connecting trusses at the corridor are corresponded to an upper chord layer, a middle chord layer and a lower chord layer of the corridor truss structures in positions of each cantilever truss with arc-shaped facades, and are in the form of multiplane truss structures;

each orthogonal connecting truss at the corridor is composed of outer chords of the orthogonal trusses at the corridor, inner chords of the orthogonal trusses at the corridor, vertical webs of the orthogonal trusses at the corridor, and diagonal webs of the orthogonal trusses at the corridor;

the vertical webs of the orthogonal trusses at the corridor and the diagonal webs of the orthogonal trusses at the corridor are arranged between the outer chords of the orthogonal trusses at the corridor and the inner chords of the orthogonal trusses at the corridor; the orthogonal connecting trusses at the corridor are rigidly connected to the cantilever trusses with arc-shaped facades by outer chord rigid connecting ends of the orthogonal trusses at the corridor and inner chord rigid connecting ends the orthogonal trusses at the corridor;

each orthogonal connecting truss at the corridor is in the form of a planar truss with uniform section having a width of 3-6 m, and distance between two adjacent orthogonal connecting trusses at the corridor is 4-8 m; and each cross section of the outer chords of the orthogonal trusses at the corridor, the inner chords of the orthogonal trusses at the corridor, the vertical webs of the orthogonal trusses at the corridor and the diagonal webs of the orthogonal trusses at the corridor is a circular pipe, a diameter of each outer chord of the orthogonal trusses at the corridor and each inner chord of the orthogonal trusses at the corridor is 400-800 mm, and a diameter of each vertical web of the orthogonal trusses at the corridor and each diagonal web of the orthogonal trusses at the corridor web is 200-500 mm.

5. The large-span corridor structure composed of arc-shaped cantilever trusses and stay cable supporting structures according to claim 1, wherein the connecting trusses at cantilever portions are located between the several ultra-long cantilever trusses with arc-shaped facades and triquetrous planes of each set of cantilever trusses with arc-shaped facades;

each connecting truss at cantilever portions is composed of outer chords of the connecting trusses at cantilever portions, inner chords of the connecting trusses at cantilever portions, vertical webs of the connecting trusses at cantilever portions, and diagonal webs of the connecting trusses at cantilever portions, the vertical webs of the connecting trusses at cantilever portions, and diagonal webs of the connecting trusses at cantilever portions are provided between the outer chords of the connecting trusses at cantilever portions and the inner chords of the connecting trusses at cantilever portions;

the connecting trusses at cantilever portions are rigidly connected to the cantilever trusses with arc-shaped facades by outer chord rigid connecting ends of the connecting trusses at cantilever portions and inner chord rigid connecting ends of the connecting trusses at cantilever portions;

a width of each connecting truss at cantilever portions is 1-4 m and is same as a width at a position corresponding to the cantilever trusses with arc-shaped facades, distance between two connecting trusses at cantilever portions adjacent is 8-14 m; and each cross section of the outer chords of the connecting trusses at cantilever portions, the inner chords of the connecting trusses at cantilever portions, the vertical webs of the connecting trusses at cantilever portions, and the diagonal webs of the connecting trusses at cantilever portions is a circular pipe, a diameter of each outer chord of the connecting trusses at cantilever portions and each inner chord of the connecting trusses at cantilever portions is 300-600 mm, and a diameter of each vertical web of the connecting trusses at cantilever portions, and each diagonal web of the connecting trusses at cantilever portions is 200-400 mm.

6. The large-span corridor structure composed of arc-shaped cantilever trusses and stay cable supporting structures according to claim 1, wherein the corridor truss structures are composed of a middle large-span corridor truss area located between the two sets of cantilever trusses with arc-shaped facades, and two cantilever corridor truss areas on both sides located outside the two sets of cantilever trusses with arc-shaped facades;

number of the corridor truss structures is same as number of the ultra-long cantilever trusses with arc-shaped facades and triquetrous planes of each set of cantilever trusses with arc-shaped facades, and the corridor truss structures are composed of several double-layer trusses arranged in a longitudinal direction;

each corridor truss structure is composed of upper chords of the corridor truss structures, middle chords of the corridor truss structures, lower chords of the corridor truss structures, vertical webs of the corridor truss structures and diagonal webs of the corridor truss structures, which form a double-layer-union jack-shaped diagonal bracing truss structure, the vertical webs of the corridor truss structures and the diagonal webs of the corridor truss structures are arranged between the upper chords of the corridor truss structures, the middle chords of the corridor truss structures and the lower chords of the corridor truss structures; each corridor truss structures is a double-layer roof floor structure, roof connecting steel beams of the corridor truss structures and floor connecting steel beams of the corridor truss structures are respectively arranged on roof and floor of the corridor truss structures and are rigidly connected to each corridor truss structure; stiffeners of steel truss joint are provided at intersections of the diagonal webs of the corridor truss structures.

7. The large-span corridor structure composed of arc-shaped cantilever trusses and stay cable supporting structures according to claim 6, wherein both ends of the middle large-span corridor truss area are rigidly supported on the outer chord rigid connecting ends of the orthogonal connecting trusses at the corridor, the cantilever ends of the cantilever corridor truss area on both sides are rigidly supported on the inner chord rigid connecting ends of the orthogonal connecting trusses at the corridor;

roof horizontal stay cables of the corridor truss structures and floor horizontal stay cables of the corridor truss structures are respectively arranged on the roof and the floor of the corridor truss structures;

each corridor truss structure is in the form of a planar truss with uniform section; a single-layer height of each corridor truss structure is 4-5 m, a corresponding double-layer height is 8-10 m, and space between two corridor truss structures adjacent is 8-15 m;

each cross section of members of the upper chords of the corridor truss structures, the middle chords of the corridor truss structures and the lower chords of the corridor truss structures is a box-shaped cross section with a height of 600-800 mm;

each cross section of members of the vertical webs of the corridor truss structures and the diagonal webs of the corridor truss structures is a box-shaped cross section with a height of 300-500 mm;

each cross section of members of the roof connecting steel beams of the corridor truss structures and the floor connecting steel beams of the corridor truss structures is a H-shaped cross section with a height 400-600 mm; and each cross-section of members of the roof horizontal stay cable of corridor truss structures and the floor horizontal stay cable of corridor truss structures is a H-shaped cross section or a solid steel strut.

8. The large-span corridor structure composed of arc-shaped cantilever trusses and stay cable supporting structures according to claim 1, wherein the stay cable supporting structures are composed of multiple sets of stay cables of the stay cable supporting structures, and located above the cantilever corridor truss areas on both sides and the middle large-span corridor truss area, top suspending ends of the stay cable supporting structures located above the cantilever corridor truss areas on both sides are respectively located at the top cantilever ends of cantilever trusses with arc-shaped facades and the inner chords of connecting trusses at cantilever portions; the top suspending ends of the stay cable supporting structure located above the middle large-span corridor truss area is located at the outer chords of the connecting trusses at cantilever portions;

bottom suspending ends of the stay cable supporting structures are located at joints of the upper chords of the corridor truss structures; stay cables of the corridor truss structures is obliquely arranged;

ends of the stay cables of the corridor truss structures are hinged and connected using column hinge joints, the upper chords of the corridor truss structures at joints are provided with stiffeners of stay cable end joints;

each member of the stay cables of the corridor truss structures is a solid steel strut, and a diameter of each cross section of members of the stay cables of the corridor truss structures is 60-150 mm; and angle of inclination of each stay cable of the corridor truss structures is between 15 degrees-45 degrees.

9. A method for constructing the large-span corridor structure composed of arc-shaped cantilever trusses and stay cable supporting structures according to claim 1, comprising the following steps:

S1, constituting a set of cantilever trusses with arc-shaped facades using outer chords of the cantilever trusses with arc-shaped facades, inner chords of the cantilever trusses with arc-shaped facades, vertical webs of the cantilever trusses with arc-shaped facades, and diagonal webs of the cantilever trusses with arc-shaped facades, two sets of the cantilever trusses with arc-shaped facades are symmetrically arranged at both sides based on a central positioning point, and bottoms of the cantilever trusses with arc-shaped facades are landing supported at bottom landing ends of the cantilever trusses with arc-shaped facades, tops of the cantilever trusses with arc-shaped facades are cantilevered to the top cantilever ends of cantilever trusses with arc-shaped facades to form a main body structure of the two sets of the cantilever trusses with arc-shaped facades landing fixedly supported;

S2, constituting the orthogonal connecting trusses at the corridor in a form of planar truss using outer chords of the orthogonal connecting trusses at the corridor, inner chords of the orthogonal connecting trusses at the corridor, vertical webs of the orthogonal connecting trusses at the corridor and diagonal webs of the orthogonal connecting trusses at the corridor;

S3, arranging orthogonally the main body structure of the cantilever trusses with arc-shaped facades generated in S1 and the orthogonal connecting trusses at the corridor generated in S2, and connecting rigidly outer chord rigid connecting ends of the orthogonal connecting trusses at the corridor to inner chord rigid connecting ends of the orthogonal connecting trusses at the corridor, so as to form a core support framework together;

S4, constituting the connecting trusses at cantilever portions using outer chords of the connecting trusses at cantilever portions, inner chords of the connecting trusses at cantilever portions, vertical webs of the connecting trusses at cantilever portions and diagonal webs of the connecting trusses at cantilever portions;

S5, connecting rigidly the connecting trusses at cantilever portions generated in S4 through cantilever portions of each set of the cantilever trusses with arc-shaped facades to outer chord rigid connecting ends of the connecting trusses at cantilever portions and inner chord rigid connecting ends; of the connecting trusses at cantilever portions S6, constituting a main body structure of each corridor truss structure using upper chords of the corridor truss structures, middle chords of the corridor truss structures, lower chords of the corridor truss structures, vertical webs of the corridor truss structures and diagonal webs of the corridor truss structures;

S7, connecting every corridor truss structure generated in S6 by roof connecting steel beams of the corridor truss structures and floor connecting steel beams of the corridor truss structures, so as to form the corridor truss structures, and enhancing the corridor truss structures by stiffeners of steel truss joints at intersections of diagonal webs of the corridor truss structures;

S8, improving in-plane torsional rigidity of the corridor truss structures generated in S7 by roof horizontal stay cables of the corridor truss structures and floor horizontal stay cables of the corridor truss structures;

S9, large-span supporting ends of the corridor truss structures is the outer chord rigid connecting ends of the orthogonal connecting trusses at the corridor, and cantilever supporting ends of the corridor truss structures is the inner chord rigid connecting ends of the orthogonal connecting trusses at the corridor;

S10, connecting the bottom ends of the stay cables of the stay cable supporting structures to bottom suspending ends of the stay cable supporting structures at joints of the upper chords of the corridor truss structures, connecting the top ends of the stay cables of the stay cable supporting structures to the top cantilever ends of the cantilever trusses with arc-shaped facades, the inner chords of the connecting trusses at cantilever portions, or top suspending ends of the stay cable supporting structures at the outer chords of the connecting trusses at cantilever portions, enhancing the upper chords of the corridor truss structures at joints of connecting ends of the stay cables by stiffeners of the stay cable end joints.

* * * * *